US012276112B2

(12) United States Patent
Hollenback et al.

(10) Patent No.: US 12,276,112 B2
(45) Date of Patent: Apr. 15, 2025

(54) STAIRS AND PLATFORM SYSTEM FOR MOBILE ELEVATED SHELTER

(71) Applicant: BERG COMPANIES, INC., Spokane, WA (US)

(72) Inventors: David M. Hollenback, Spokane Valley, WA (US); Nicholas W. Adams, Spokane, WA (US)

(73) Assignee: BERG COMPANIES, INC., Spokane, WA (US)

( * ) Notice: Subject to any disclaimer, the term of this patent is extended or adjusted under 35 U.S.C. 154(b) by 108 days.

(21) Appl. No.: 17/961,539

(22) Filed: Oct. 6, 2022

(65) Prior Publication Data

US 2023/0103897 A1 Apr. 6, 2023

Related U.S. Application Data

(60) Provisional application No. 63/252,863, filed on Oct. 6, 2021.

(51) Int. Cl.
*E04F 11/06* (2006.01)
*E04F 11/18* (2006.01)

(52) U.S. Cl.
CPC ..... *E04F 11/062* (2013.01); *E04F 11/1865* (2013.01)

(58) Field of Classification Search
CPC ..... E04F 11/062; E04F 11/1865; E06C 5/24; E06C 7/182; E06C 5/04; B60R 3/007; B60R 3/02; E04G 27/00
See application file for complete search history.

(56) References Cited

U.S. PATENT DOCUMENTS 3,693,754 A * 9/1972 Butler ..... E04F 11/062 182/86
3,912,298 A * 10/1975 Humphrey ..... B60R 3/02 182/115

(Continued)

*Primary Examiner* — Gisele D Ford
(74) *Attorney, Agent, or Firm* — Lippes Mathias LLP

(57) ABSTRACT

A shelter includes a body having a wall. A stairs and platform system is connected adjacent the wall of the shelter. The stairs and platform system includes a platform and a stair assembly. The platform includes: (i) first and second spaced-apart side rails and a platform floor located between the first and second side rails; and (ii) first and second platform handrail assemblies respectively located on opposite first and second lateral sides of the platform. The stair assembly is connected to the platform to provide access to the platform and is movable relative to the platform from a first operative position in which the stair assembly projects outwardly away from the platform to a second stowed position in which the stair assembly is retracted relative to the platform and at least part of the stair assembly is supported adjacent the platform. The first and second platform handrail assemblies are each selectively configurable to be in: (i) an operative position in which the first and second platform handrail assemblies project respectively upwardly from the opposite first and second lateral sides of the platform; and (ii) a stowed position in which the first and second platform handrail assemblies engage both the platform and the stair assembly to capture and retain the stair assembly in its stowed position.

20 Claims, 19 Drawing Sheets

(56) References Cited

U.S. PATENT DOCUMENTS 3,997,211 A * 12/1976 Graves ..... B60R 3/02 182/116
4,347,638 A 9/1982 Weaver
5,033,582 A * 7/1991 Hoben ..... B60R 3/02 182/127
5,397,143 A * 3/1995 Bird ..... B60R 3/02 280/166
6,347,686 B1 2/2002 Hedley et al.
6,810,995 B2 * 11/2004 Warford ..... E06C 7/081 182/115
8,371,077 B2 * 2/2013 Delhomme ..... E04F 11/04 52/183
8,397,869 B2 * 3/2013 Tsutsumi ..... E02F 9/0833 182/127
8,931,792 B1 1/2015 Klassen
8,991,842 B1 * 3/2015 Teno, III ..... B60R 3/02 280/163
9,238,941 B2 1/2016 Ellement
9,308,869 B1 4/2016 Owens, Jr.
10,093,238 B2 10/2018 Koga
10,449,904 B2 10/2019 Feinberg et al.
10,533,374 B2 1/2020 Jevaney et al.
10,920,445 B2 2/2021 Montesalvo
2003/0188925 A1 * 10/2003 Korpi ..... E06C 5/02 182/127
2012/0073902 A1 * 3/2012 Honeycutt ..... E04G 1/17 182/113
2012/0205195 A1 * 8/2012 Tsutsumi ..... E02F 9/0833 182/106
2013/0008743 A1 * 1/2013 Hedley ..... E06C 7/183 182/95
2013/0092474 A1 4/2013 Magnussen
2014/0239609 A1 8/2014 Robertson
2018/0066474 A1 * 3/2018 Johansson ..... E06C 7/44
2018/0094484 A1 * 4/2018 Frame ..... E06C 1/20
2020/0055528 A1 * 2/2020 Pauker ..... B60R 3/02
2020/0080315 A1 * 3/2020 Shelton ..... E04F 11/1865
2020/0274391 A1 * 8/2020 Quigley ..... B60R 3/02
2021/0146842 A1 * 5/2021 Niemela ..... B60R 9/06
2022/0185189 A1 * 6/2022 Houston ..... E04F 11/022
2024/0018787 A1 * 1/2024 Ellement ..... E06C 5/42

* cited by examiner

STAIRS AND PLATFORM SYSTEM FOR MOBILE ELEVATED SHELTER

CROSS-REFERENCE TO RELATED APPLICATION

This application claims priority from and benefit of the filing date of U.S. provisional application Ser. No. 63/252,863 filed Oct. 6, 2021, and the entire disclosure of said provisional application is hereby expressly incorporated by reference into the present specification.

BACKGROUND

Portable shelters for transportation to and deployment at a remote site are widely known. These shelters are used by the military and others for establishing field offices, field hospitals, barracks, combat shelters, kitchens, mess halls, command posts, communication centers, and other structures. Such portable shelters often include one or more expandable and collapsible wall sections and/or roof sections that allow the shelter to be selectively collapsed for storage and transportation of the shelter in a stowed configuration and that can be selectively expanded for use of the shelter in a deployed configuration.

These shelters are often mounted upon a vehicle such as a truck, trailer or other vehicle so as to be mobile when in the stowed configuration. As such, when deployed, the shelter is typically elevated above the ground or other support surface on which the vehicle is supported, which requires that the shelter be equipped with a ladder, stairs, ramp, a powered (pneumatic, hydraulic, electric) lift or other means for facilitating ingress and egress of personnel with respect to the interior of the shelter when it is deployed. While a wide variety of stairs, ladders, platforms, and the like are known, these known devices and structures are suboptimal for use with a portable shelter for reasons including excessive complexity for deployment and storage, complicated assembly and disassembly, use of loose parts that can be misplaced or damaged, the need to store large parts of the stairs and/or platform inside or separate from the shelter when the shelter is in its stowed configuration, and interference of the stairs or platform components with the ability to store or transport the shelter when in its stowed configuration. Accordingly, a need has been identified for a new and improved stairs and platform system for a mobile shelter that overcomes the above and other deficiencies of known system while providing better overall results.

SUMMARY

In accordance with one aspect of the present development, a shelter includes a body having a wall. A stairs and platform system is connected adjacent the wall of the shelter. The stairs and platform system includes a platform and a stair assembly. The platform includes: (i) first and second spaced-apart side rails and a platform floor located between the first and second side rails; and (ii) first and second platform handrail assemblies respectively located on opposite first and second lateral sides of the platform. The stair assembly is connected to the platform to provide access to the platform and is movable relative to the platform from a first operative position in which the stair assembly projects outwardly away from the platform to a second stowed position in which the stair assembly is retracted relative to the platform and at least part of the stair assembly is supported adjacent the platform. The first and second platform handrail assemblies are each selectively configurable to be in: (i) an operative position in which the first and second platform handrail assemblies project respectively upwardly from the opposite first and second lateral sides of the platform; and (ii) a stowed position in which the first and second platform handrail assemblies engage both the platform and the stair assembly to capture and retain the stair assembly in its stowed position.

In accordance with another aspect of the present development, a stairs and platform system for a shelter includes a platform adapted to be connected to an associated shelter. The platform includes: (i) first and second spaced-apart side rails and a platform floor located between the first and second side rails; and (ii) first and second platform handrail assemblies. A stair assembly is connected to the platform and is selectively positionable relative to the platform in: (i) a first, operative position in which the stair assembly projects outwardly away from the platform to provide access to the platform; and (ii) a second, stowed position in which the stair assembly is retracted relative to the platform and at least part of the stair assembly is supported adjacent the platform. The first and second platform handrail assemblies are each selectively positionable in: an operative position in which the first and platform handrail assemblies project respectively upward on opposite lateral sides of the platform; and (ii) a stowed position in which the first and second platform handrail assemblies engage both the platform and the stair assembly to capture and retain the stair assembly in its stowed position.

DETAILED DESCRIPTION

Figure 1:
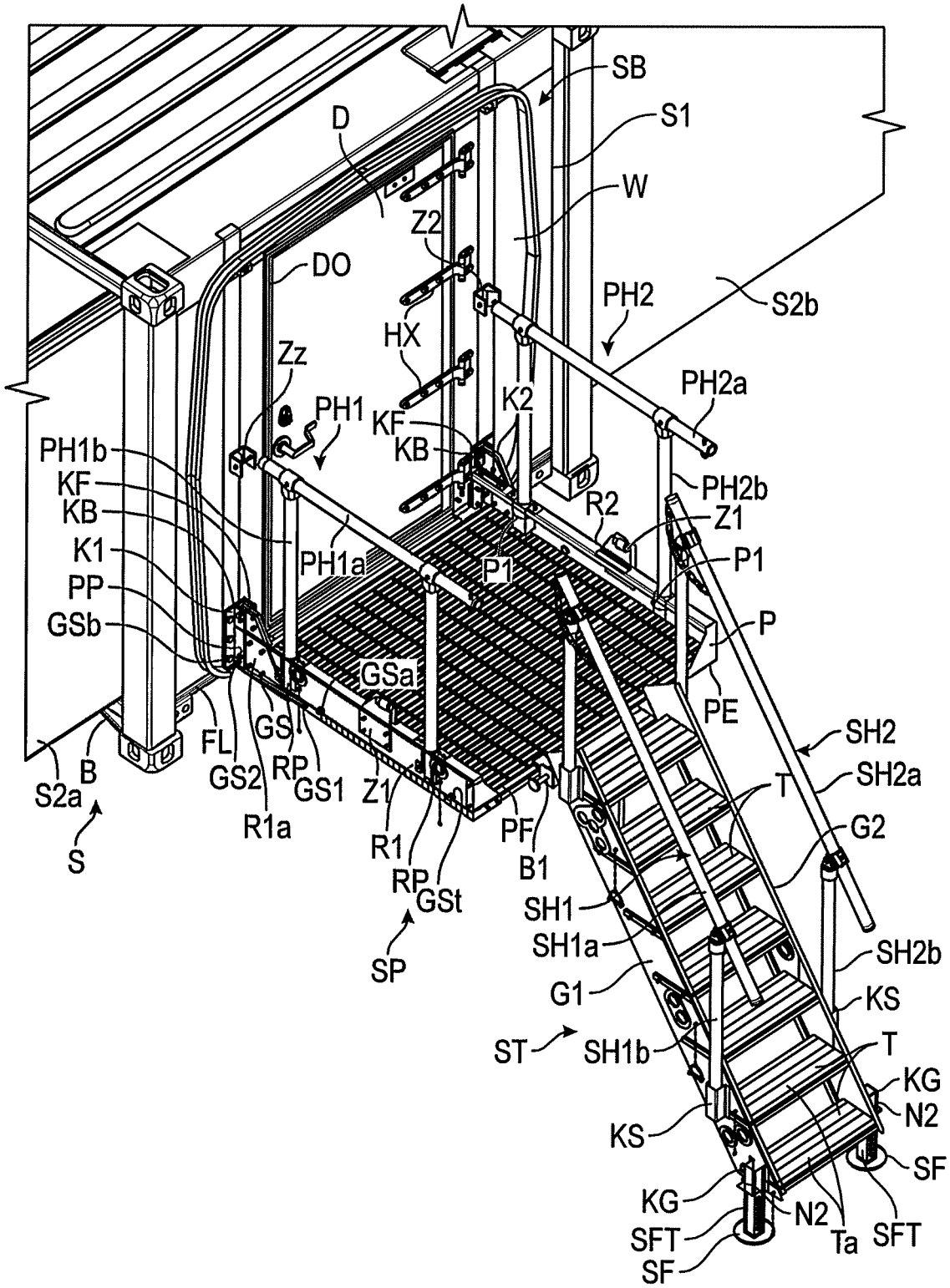
FIGS. 1 & 2 are respective partial left and right side isometric views of a shelter comprising a stairs and platform system in accordance with an embodiment of the present disclosure.
Figure 2:
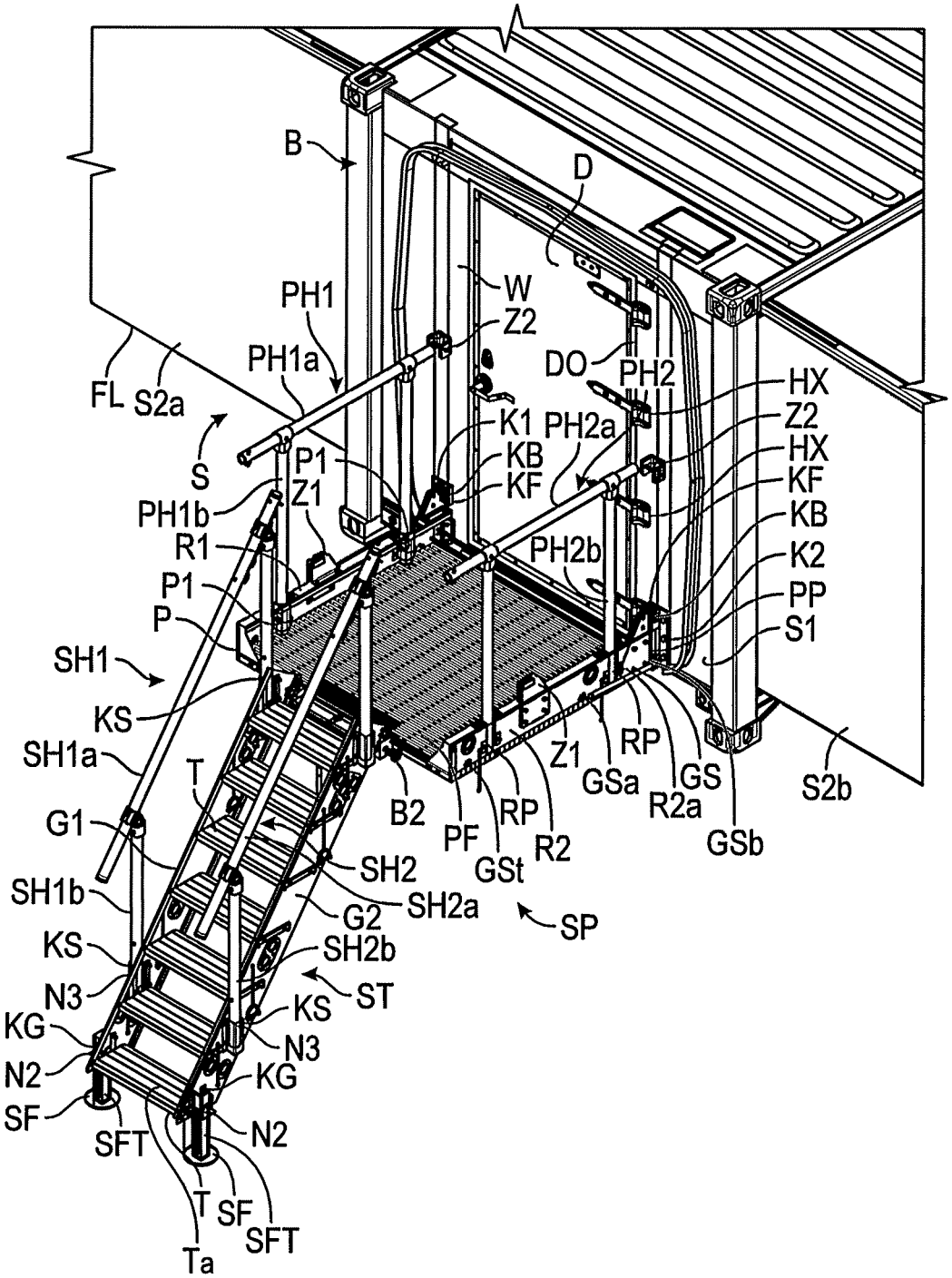
Figure 3:
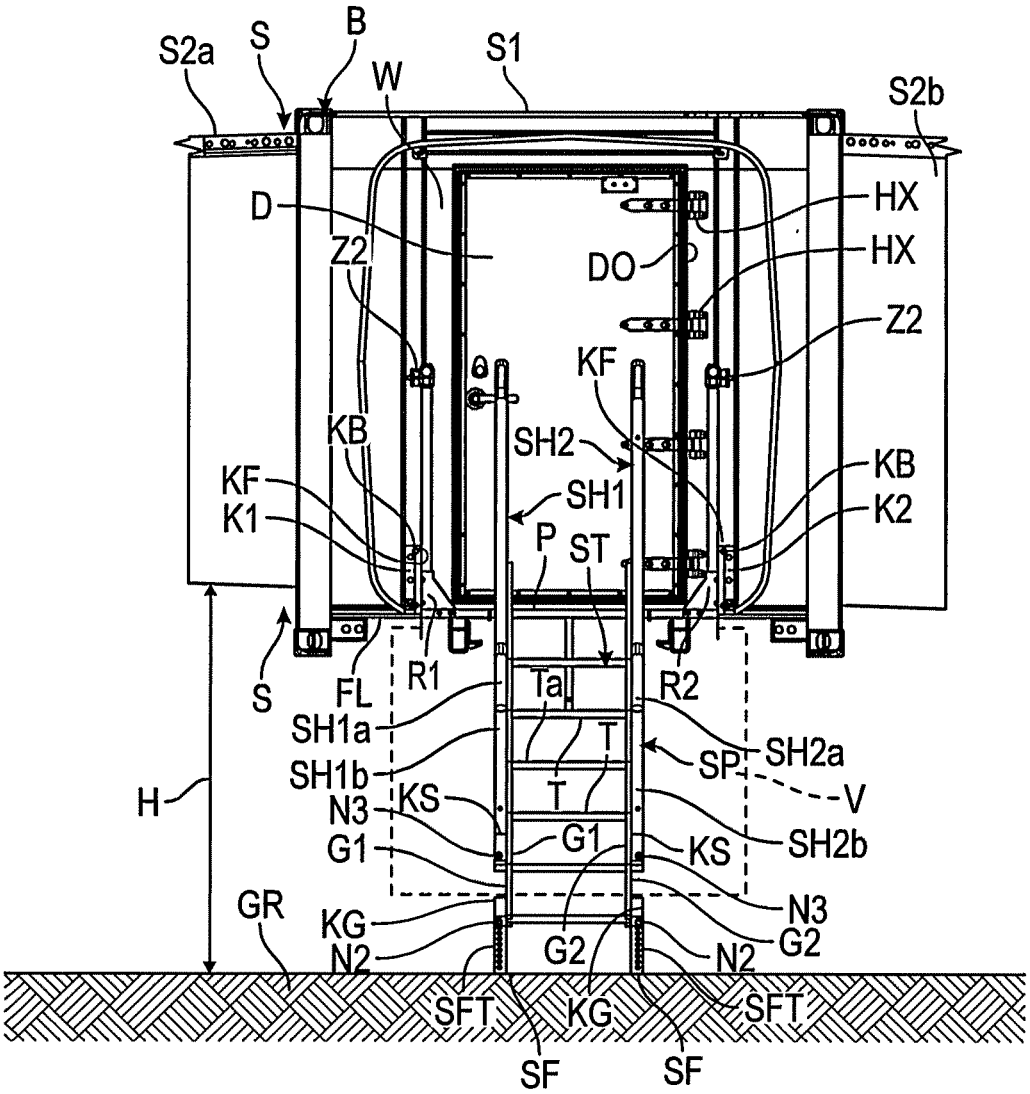
FIG. 3 is a partial front elevation view of the shelter of FIGS. 1 & 2.
Figure 4:
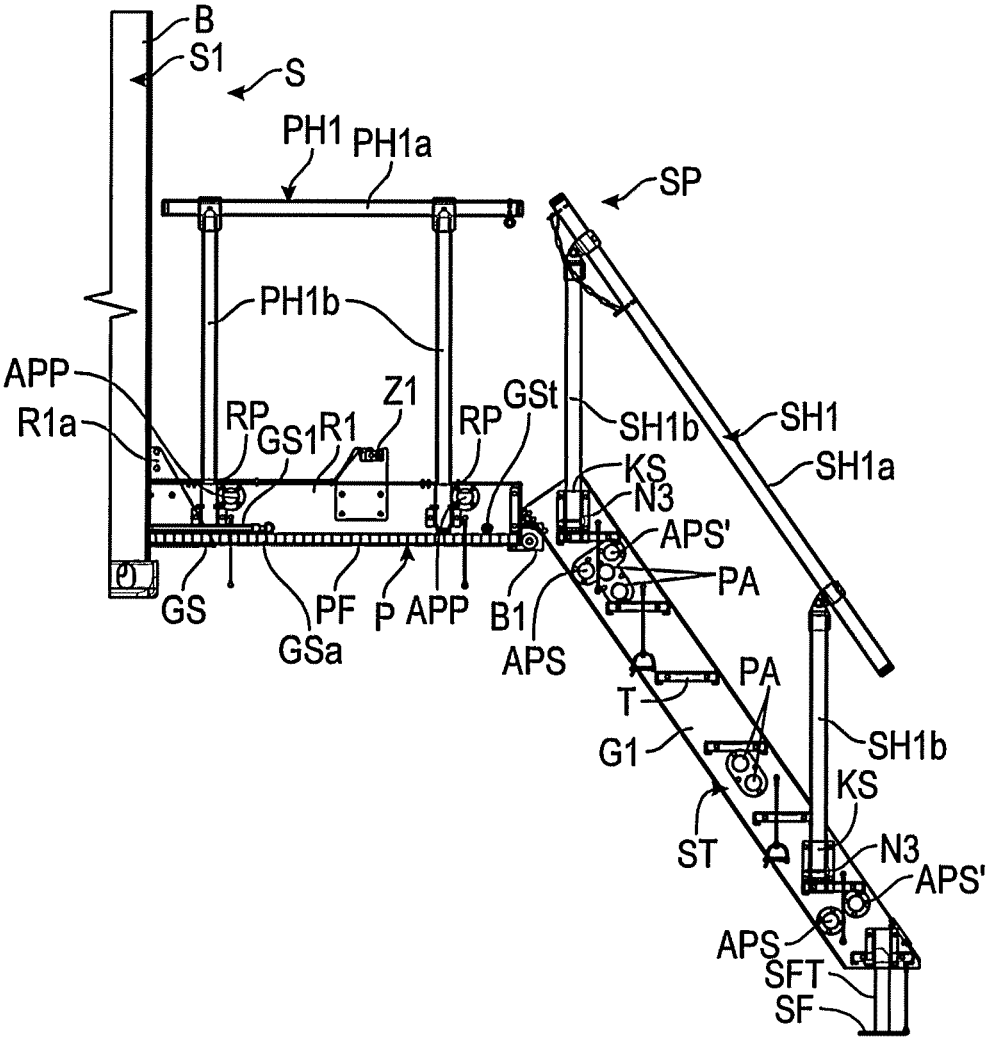
FIGS. 4 & 5 are respective partial left and right side views of the shelter of FIGS. 1-3.
Figure 5:
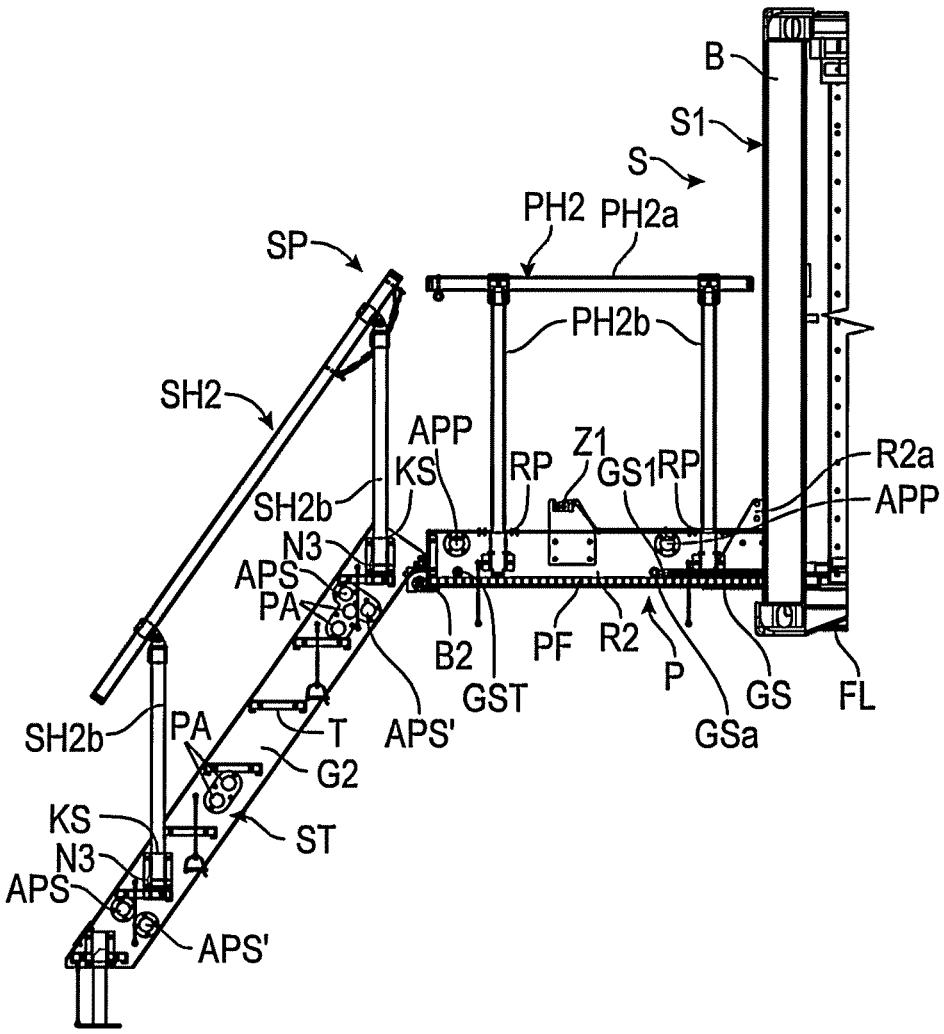

FIGS. 1 & 2 are respective partial left and right isometric side views of one example of a shelter S that comprises a stairs and platform system SP provided in accordance with one embodiment of the present development. FIG. 3 is a partial front elevation view of the shelter S of FIGS. 1 & 2. FIGS. 4 & 5 are respective left and right partial side views of the shelter S of FIGS. 1-3.

Referring to all of FIGS. 1-5, the shelter S is typically mounted on a frame, platform, chassis, or other elevated support structure of a vehicle such as a truck or trailer (diagrammatically shown at V in FIG. 3), or the shelter S can be mounted on a fixed (non-mobile) elevated structure such that the base or floor FL of the shelter S is elevated above a support surface such as a floor or ground surface GR by a distance or height H. The illustrated shelter S is intended to be a non-limiting example and can alternatively be provided in any of a wide variety of other configurations without departing from the scope and intent of the present development.

In the illustrated example, the shelter S comprises a body SB including primary shelter portion S1 and further comprises one or more movable secondary shelter portions S2*a*,S2*b* (each only partially shown) that move relative to the primary shelter portion S1 between a retracted or stowed position where they are each retracted relative to and/or into the primary shelter portion S1 for storage and transport of the shelter S and an extended or deployed position where the secondary shelter portions S2*a*,S2*b* are each extended relative to and project outwardly from the primary shelter portion S1 (as shown in FIG. 1) for operative use of the shelter S.

The shelter body B comprises a vertical wall W including a door opening DO that provides access to an interior space. A door D is pivotally or otherwise movably connected to the shelter body B adjacent the door opening DO for selectively opening and closing the door opening DO. In the illustrated example, the door opening DO is defined in an end wall W of the primary shelter portion S1, and the door D is pivotably connected adjacent the door opening DO by multiple hinges HX for pivoting movement about a vertical pivot axis between the door-opened and door-closed positions, but the door opening DO can be provided in any other wall of the shelter S and it is not intended that the present development be limited to the location of the door opening DO and door D as shown herein. The stairs and platform system can be attached to the shelter body SB adjacent the wall W.

Figure 6:
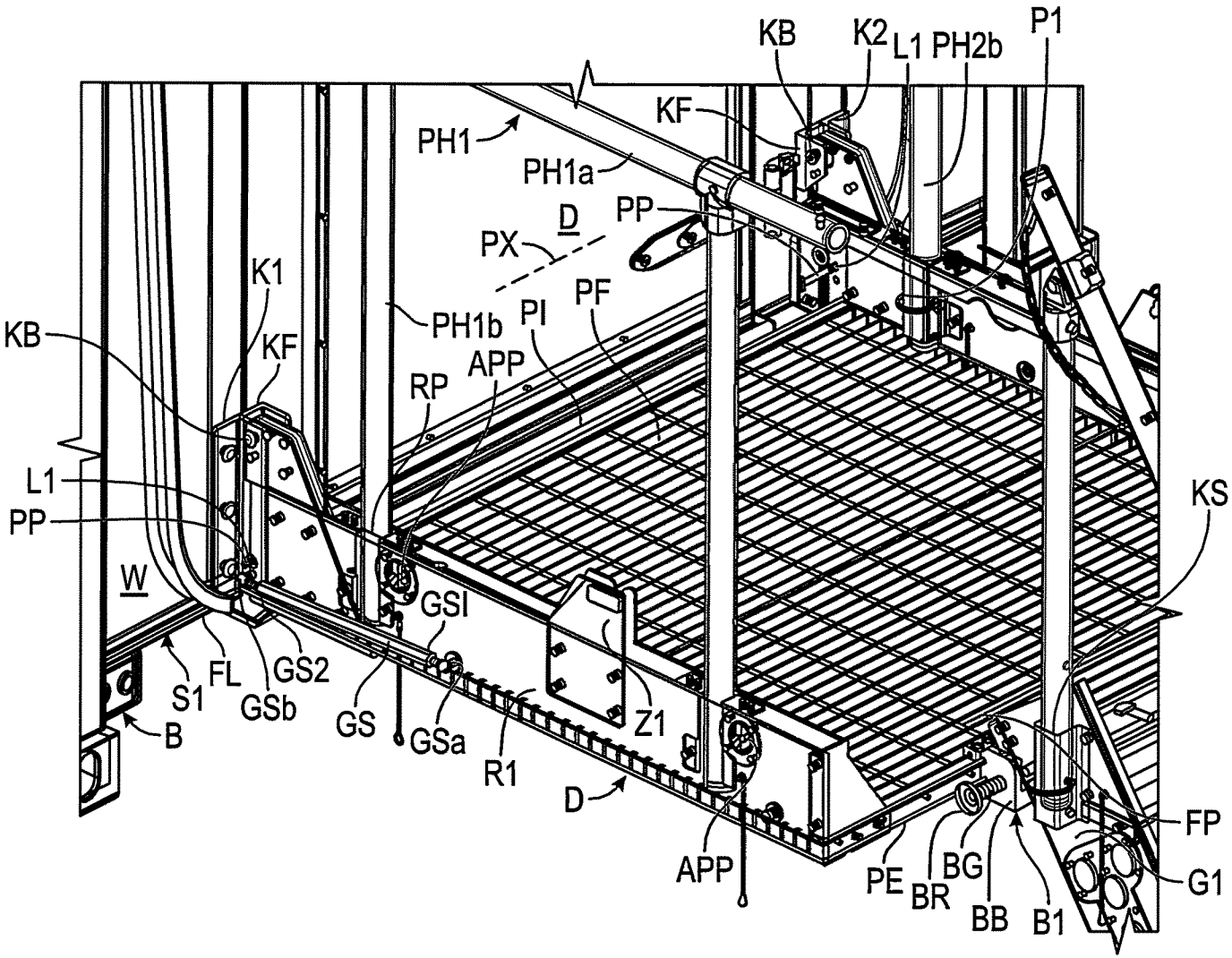
FIGS. 6 & 7 respectively show enlarged portions of FIGS. 1 & 2.
Figure 7:
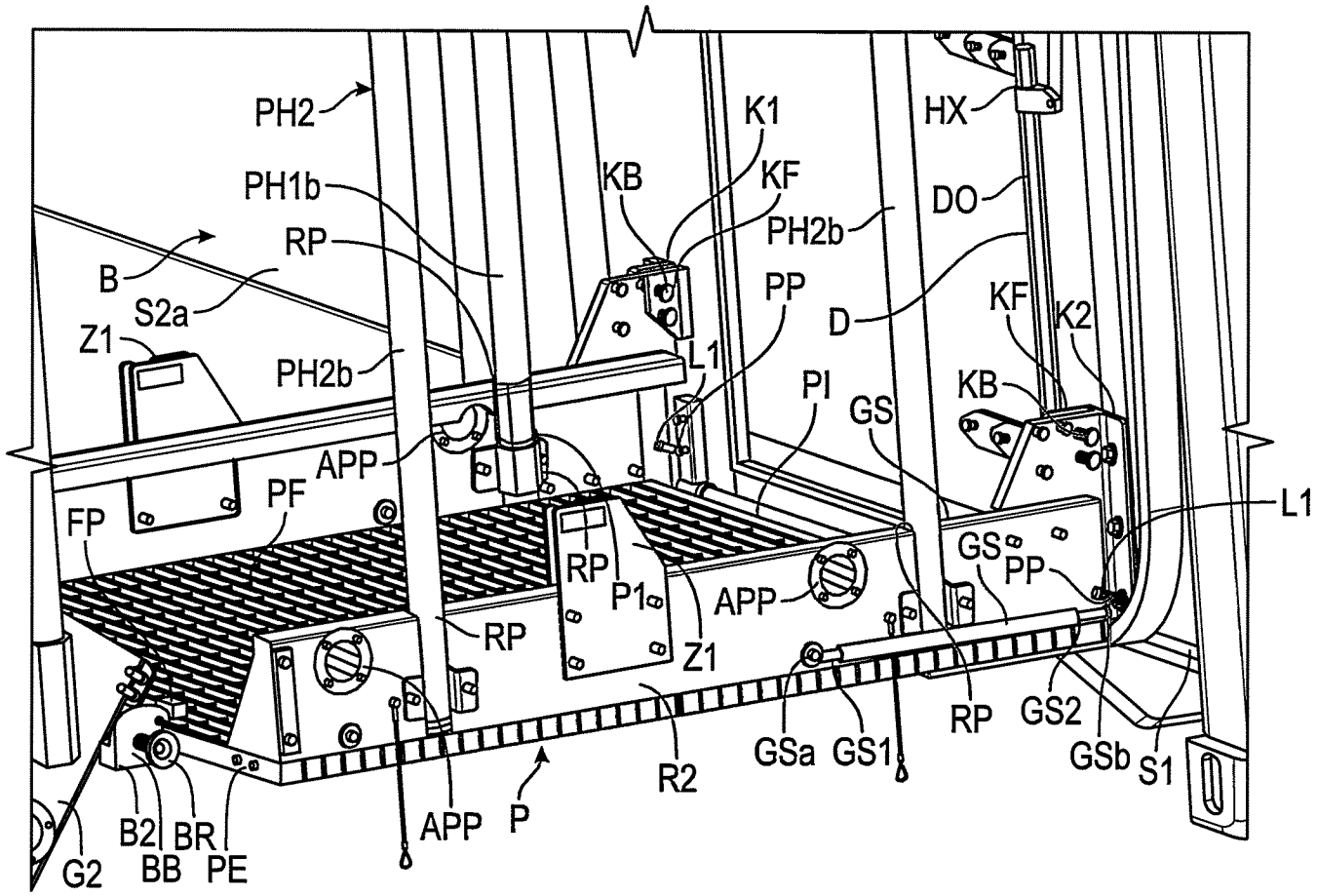

With reference also to the enlarged partial left and right isometric views of FIGS. 6 & 7, the stairs and platform system SP can comprise first and second (left and right) platform mounting brackets K1,K2 that are bolted, welded, or otherwise fixedly secured to the shelter wall W or other part of the shelter body SB such as respectively adjacent opposite first and second (left and right) lateral sides of the door opening DO and also adjacent the floor FL of the primary shelter portion S1 so that the brackets KLK2 are located adjacent a lower end of the door opening DO on opposite sides thereof. The brackets K1,K2 can be one-piece or multi-piece structures. The brackets K1,K2 can alternatively be mounted elsewhere on the shelter body SB where it is desired to connect the stairs and platform system SP.

Figure 14:
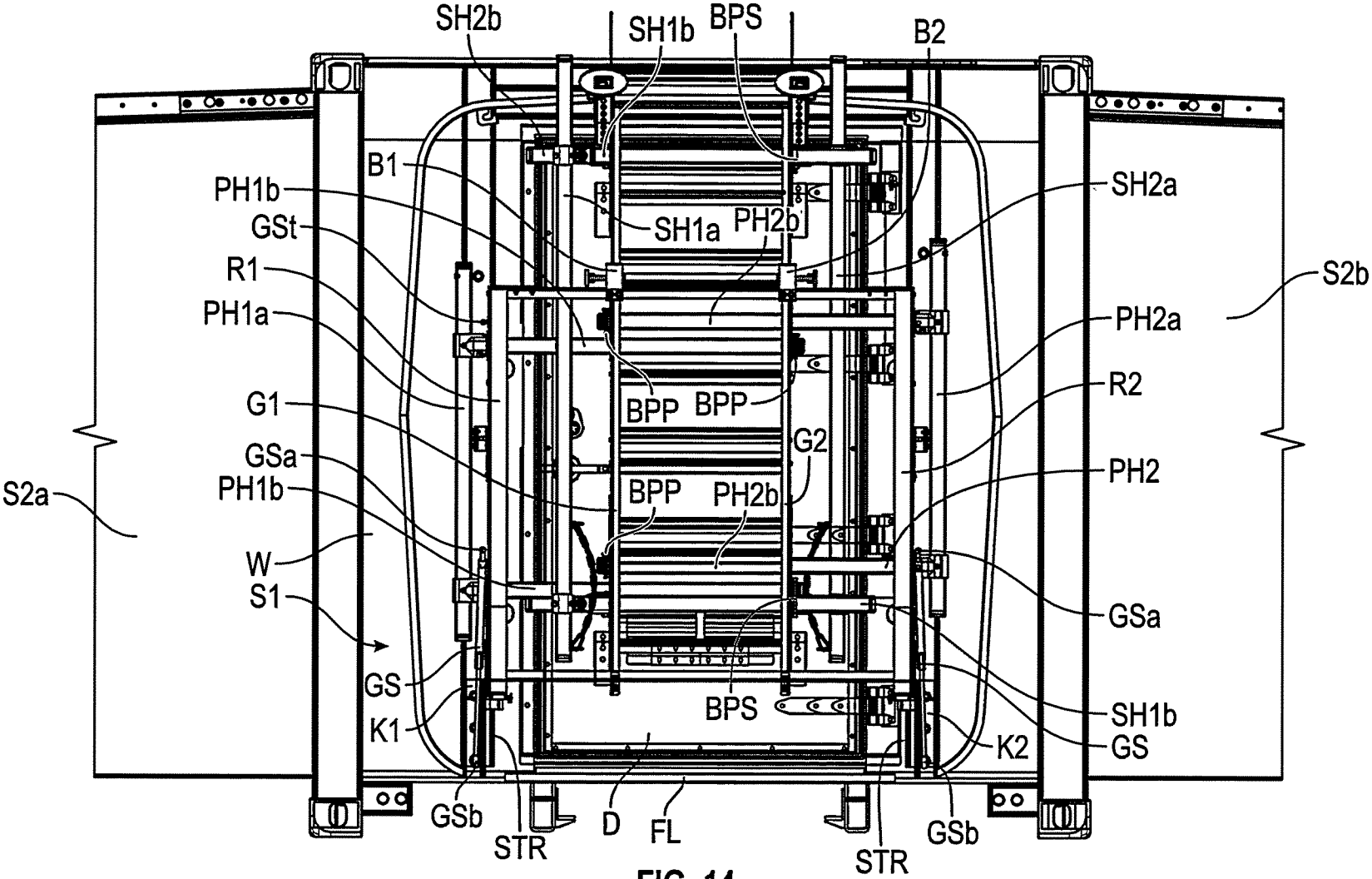
FIG. 14 is a front view of the shelter of FIGS. 1 & 2 with both the stair assembly and the platform in the stowed/retracted position.
Figure 15:
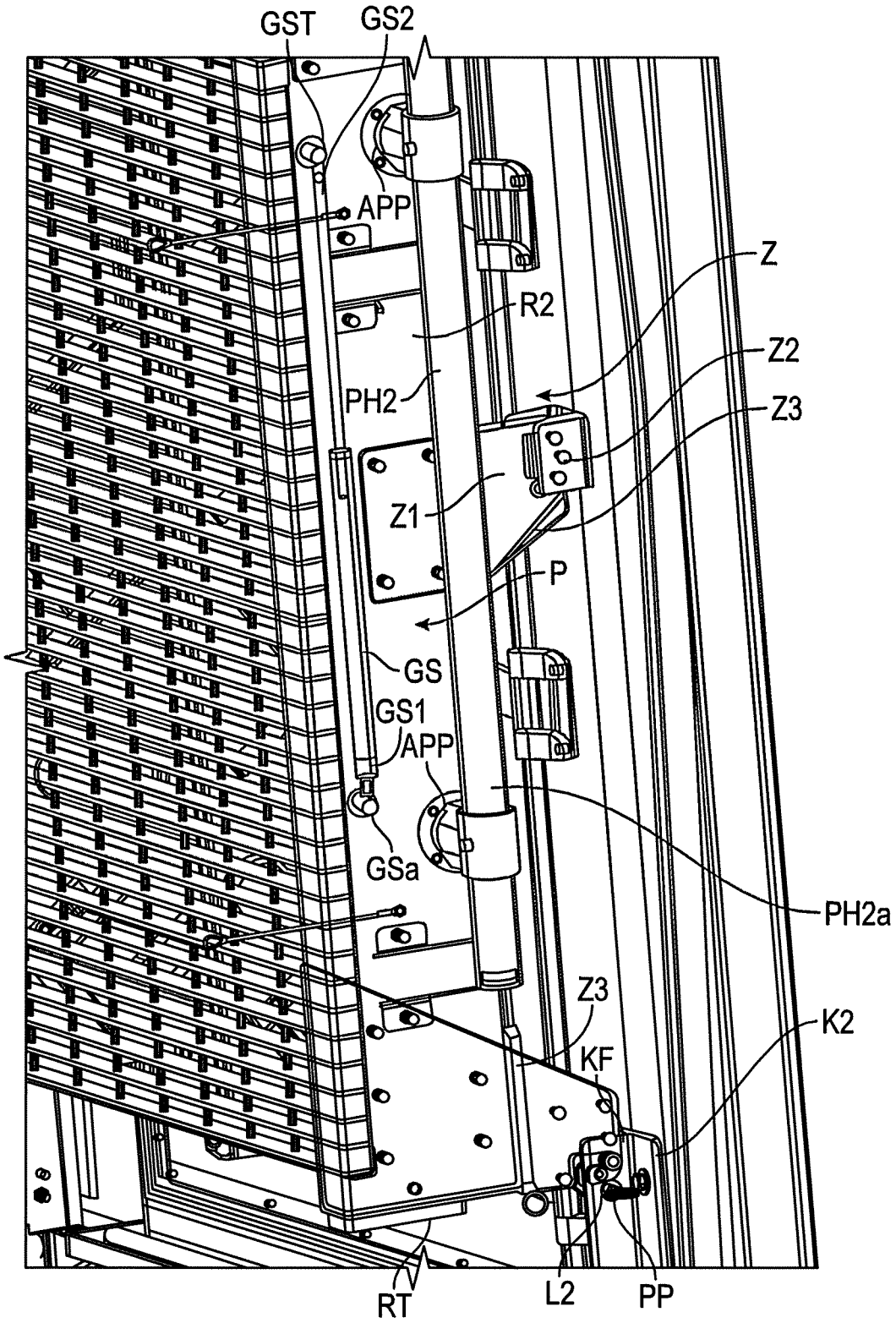
FIG. 15 provides an enlarged partial isometric view that shows the pivoting connection of the platform to the shelter, with the platform in its stowed/retracted position.

Each bracket K1,K2 comprises a platform mounting portion KF such as a tab, flange, U-shaped channel or other that extends outwardly away from the shelter wall W and to which a platform assembly or platform P provided in accordance with an embodiment of the present development is pivotally connected such that the platform P is pivotally movable and positionable relative to the shelter wall W and door opening DO about a horizontal pivot axis PX between an operative extended or deployed (down) first position as shown in FIGS. 1-5 and an inoperative retracted or stowed (up) second position as shown in FIGS. 12-15 (note that in FIG. 14 a floor PF of the platform P has been removed to reveal other structures). As such, the platform P can be configured to be in either its operative or stowed position. In the illustrated example, a pivot mount such as a pin or bolt KB is connected to the bracket platform mounting portion KF and provides a mount structure or location for operative pivoting connection of the platform P thereto about the pivot axis PX as described in more detail below. A platform lock pin PP is installed through a first pin-receiving location L1 of each bracket K1,K2 and through part of the platform P to lock the platform P to the brackets K1,K2 and prevent rotation or other movement such as removal of the platform P relative to each bracket K1,K2 when the lock pin PP is installed. As shown in FIG. 15, when the platform P is pivoted to or configured in its stowed position adjacent the door D, the lock pin PP can alternatively be installed in a second pin-receiving location L2 of each bracket K1,K2 to block pivoting movement of the platform P about the pivot bolt KB from its stowed position toward its deployed position so as to retain the platform P in its stowed position.

Figure 5A:
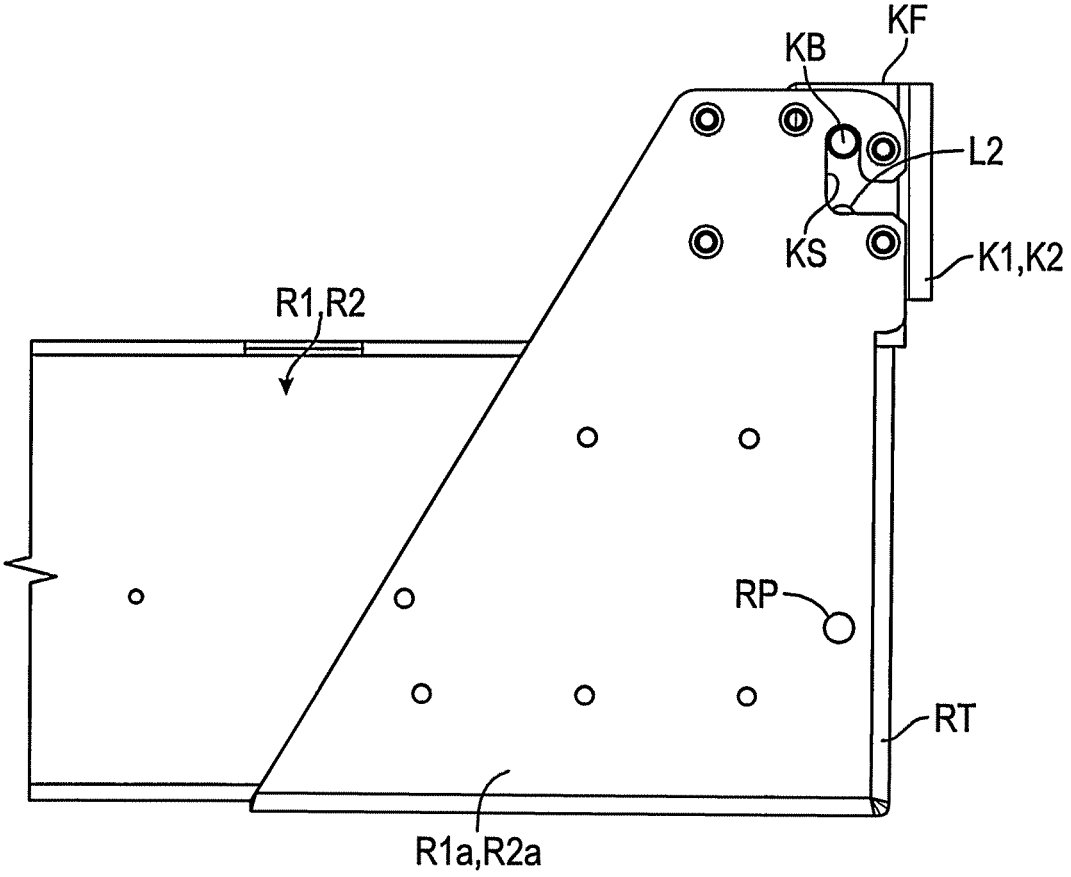
FIG. 5A is a partial right side view of one example of an inner end structure of a platform side rail configured to pivotally mount the platform to a the pivot mount of the shelter.

The platform P can be provided in any of a wide variety of shapes and sizes and generally comprises a flat platform floor PF that is must be sufficiently strong and rigid to support the weight of people and equipment located therein or moving thereacross. As shown herein, the platform floor PF comprises steel or aluminum grating, but other floor structures can be used. In the illustrated embodiment, the platform floor PF is square or otherwise rectangular and the platform P comprises first (left) and second (right) parallel, spaced-apart side rails R1,R2 respectively located on opposite first (left) and second (right) lateral sides of the platform floor PF for supporting the floor PF and connecting same to the shelter S by way of the pivot mounts KB of the platform mounting brackets K1,K2. The first and second side rails R1,R2 include respective inner ends R1*a*,R2*a* (see also FIG. 5A where a side rail R1,R2 is separately shown) that are pivotally connected to the respective platform brackets K1,K2 by the pivot mount (bolt) KB, and the platform floor PF extends between the first and second side rails R1,R2 and is supported thereby. The inner ends R1*a*,R2*a* of the platform side rails each include a stop face RT (see FIGS. 5A & 12-15) that abuts the shelter wall W, the respective bracket K1,K2, or other stop STR (FIG. 14) that is part of and/or fixed in position relative to the shelter body B such that the fully deployed operative position of the platform P is defined when the first and second stop faces RT abut the respective first and second stops STR and pivoting movement of the platform P in a first direction away from its stowed position is blocked so that the platform P is in its extended or deployed operative position, which is ordinarily when the platform P is horizontally disposed and located at approximately a 90 degree angle relative to the vertical shelter wall W. As shown in the simplified view of FIG. 5A where certain structures are removed for clarity, the inner end R1*a*,R2*a* of each platform side rail R1,R2 includes a L-shaped or other contoured open slot KS that can be slidably engaged with the pivot bolt or other pivot mount structure KB to pivotally mount the platform P to the pivot mount KB. The open slots KS in the platform rails R1,R2 allow the platform P to be retained in pivoting engagement with the respective pivot mounts KB but also allow the platform P to be selectively separated from the pivot mounts KB by sequential two-axis sliding movement of the platform P relative to the pivot mounts KB when the lock pin PP is not installed.

Referring particularly to FIGS. 6 & 7, at least one gas spring GS is operatively connected between the platform P and a mounting bracket K1,K2 or other mounting location fixed relative to the shelter body B (e.g., the primary shelter portion S1). In the illustrated embodiment, first and second gas springs GS are provided and are respectively operatively connected between the first and second mounting brackets K1,K2 and the first and second platform rails R1,R2. The gas springs GS each include a first end GS1 connected to a first gas spring anchor location GSa on the rails R1,R2 and an opposite second end GS2 connected to a second gas spring anchor location GSb on the bracket K1,K2 or elsewhere on the shelter body B. The gas springs GS are preferably pressurized and biased toward an extended position such that they assist pivoting movement of the platform P from its deployed or "down" position (FIGS. 1-5) to its stowed or "up" position (FIGS. 12-15) and so that the gas springs GS counterbalance and damp movement of the platform P in the opposite direction from the stowed position to the deployed position. It should be noted that the platform rails R1,R2 each can optionally include a temporary gas spring anchor location GSt to which the second end GS2 of the gas spring GS is connected for temporary inoperative storage of the gas spring GS with both ends GS1,GS2 affixed to the rail R1,R2 in case the second end GS2 of the gas spring is disconnected from the second anchor location GSb when the platform P is temporarily removed from the brackets K1,K2 as required for storage, maintenance, or other purpose.

The platform P preferably comprises first (left) and second (right) platform handrail assemblies PH1,PH2 located respectively adjacent the first (left) and second (right) sides of the platform P. In an alternative embodiment, only one of the platform handrail assemblies PH1,PH2 is provided. As shown herein the first and second platform handrail assemblies PH1,PH2 are respectively connected to the first and second platform side rails R1, R2. More particularly, the first platform handrail assembly PH1 comprises a platform handrail PH1*a* that extends between and is supported by at least one and preferably at least two spaced-apart platform handrail balusters PH1*b* that are releasably connected to the first side rail R1 in an operative or first position such that the first platform handrail assembly PH1 projects vertically upward and outward from the first side rail R1 in the operative position and the platform handrail PH1*a* extends parallel the first side rail R1 or otherwise extends above the first side rail R1. Similarly, the second platform handrail assembly PH2 comprises a handrail PH2*a* that extends between and is supported by at least one and preferably at least two spaced-apart platform handrail balusters PH2*b* that are releasably connected to the second side rail R2 in an operative or first position such that the second platform handrail assembly PH2 projects vertically upward and outward from the second side rail R2 in the operative position and the platform handrail PH2*a* extends parallel the second side rail R2 or otherwise extends above the second side rail R1. The first and second side rails R1,R2 include pockets RP or other receivers that are adapted to slidably receive the respective platform handrail balusters PH1*b*, PH2*b* and the balusters can be releasably retained in the pockets RP by a wide variety of suitable fasteners such as by a removable pin P1 (see also FIGS. 6 & 7) that is inserted through aligned apertures in the pocket RP and the respective baluster PH1*b*, PH2*b* or by other suitable fastener or fastening device. In the first or operative position, the first and second platform handrail assemblies PH1,PH2 project upwardly/outwardly respectively from the opposite first and second lateral sides of the platform P to provide a safety barrier.

In FIGS. 4-7, its can be seen that the first platform side rail R1 includes at least one and preferably at least two platform handrail storage apertures APP corresponding in number to the number of balusters PH1*b* of the first platform handrail assembly PH1 (i.e., the first side rail R1 includes first and second platform handrail storage apertures APP), and the second platform side rail R2 similarly includes at least one and preferably at least two platform handrail storage apertures APP corresponding in number to the number of balusters PH2*b* of the second platform handrail assembly PH2 (i.e., the second side rail R2 includes third and fourth platform handrail storage apertures APP). The two or more storage apertures APP of the first side rail R1 are conformed, dimensioned, and arranged relative to each other to slidably receive the respective balusters PH1*b* of the first platform handrail assembly PH1 when the first platform handrail assembly PH1 is moved from the first or operative position shown in FIGS. 1-7 where the balusters PH1*b* are received and retained in the pockets RP to the second or inoperative storage position as shown in FIGS. 8-15 where the balusters PH1*b* are removed from the pockets RP and slidably inserted into respective storage apertures APP of the first side rail R1. Likewise, the two or more storage apertures APP of the second side rail R2 are conformed, dimensioned, and arranged relative to each other to slidably receive the respective balusters PH2*b* of the second platform handrail assembly PH2 when the second platform handrail assembly PH2 is moved from the first/operative position shown in FIGS. 1-7 where the balusters PH2*b* are received and retained in the pockets RP to the second/inoperative storage position as shown in FIGS. 8-15 where the balusters PH2*b* are removed from the pockets RP and slidably inserted into respective storage apertures APP of the second side rail R2. In the illustrated example, the platform handrail balusters PH1*b*, PH2*b* are shorter in length than the lateral distance between the platform side rails R1,R2 such that the balusters PH1*b*, PH2*b* do not abut or extend through aligned apertures in the opposite side rail R2,R1 when installed in the storage apertures APP of the first and second rails R1,R2, but they may do so in an alternative embodiment. When the first and second platform handrail assemblies PH1,PH2 are located in their respective stowed, inoperative (second or storage) positions as shown in FIGS. 8-15, the handrails PH1*a*, PH2*a* lie respectively adjacent the first and second platform side rails R1,R2. The storage apertures APP need not have a closed perimeter and can be provided as an open notch.

The stairs and platform system SP further comprises stairs or a stair system or stair assembly ST operatively and movably connected to the platform P for providing personnel access to and from the elevated platform P to the ground GR or other support surface above which the platform P is located. The stair assembly ST generally comprises first and second stringers G1,G2 that are arranged in a parallel, spaced-apart configuration, and further comprises a plurality of steps T that extend between and that are supported by the stringers G1,G2. Each step comprises at least a tread Ta and can optionally also include a riser (not shown in the illustrated embodiment). The stair assembly ST comprises a plurality of steps T such as the illustrated seven steps, but more or less steps can be provided. The stair assembly ST can comprise first and second vertically adjustable feet SF connected respectively to the first and second stringers and that can be independently vertically extended or retracted relative to the ground surface GR such that the feet SF can be placed into contact with the ground surface GR to support the first and second stringers G1,G2 relative to the ground surface GR. In one example, a pin N2 (FIG. 3) is inserted through aligned apertures in a shaft SFT of each of the feet SF and a pocket KG the stringer G1,G2 in which the shaft SFT is slidably received to set the extended or retracted position of each of the adjustable feet SF.

The stair assembly ST is movably connected to and selectively positionable relative to the platform P. In particular, the stair assembly ST is movable to and between: (i) a first, extended, operative position or configuration as shown in FIGS. 1-7 in which the stair assembly ST is fully extended and deployed and projects outwardly and downwardly away from the platform at an angle and is arranged for use by personnel to enter/exit the platform P; and (ii) a second, retracted, or stowed position or configuration as shown in FIGS. 8-11 in which the stair assembly ST is retracted relative to the platform P and at least part of the stair assembly ST is supported adjacent the platform floor PF between the platform side rails R1,R2 (typically part of the stair assembly ST projects parallelly outwardly from and is cantilevered relative to the platform floor PF when the stair assembly is in the stowed position). In the illustrated embodiment, when the stair assembly ST is in its second, stowed/retracted position, the stair assembly ST is supported on or adjacent the platform P with at least part of both the first and second stringers G1,G2 thereof located on or adjacent the platform surface PF between the platform side rails R1,R2. The stair assembly ST can comprise a pivoting filler plate FP (FIGS. 6-7) that fills any gap located between the platform P and the stair assembly ST when the stairs ST are deployed.

Figure 10:
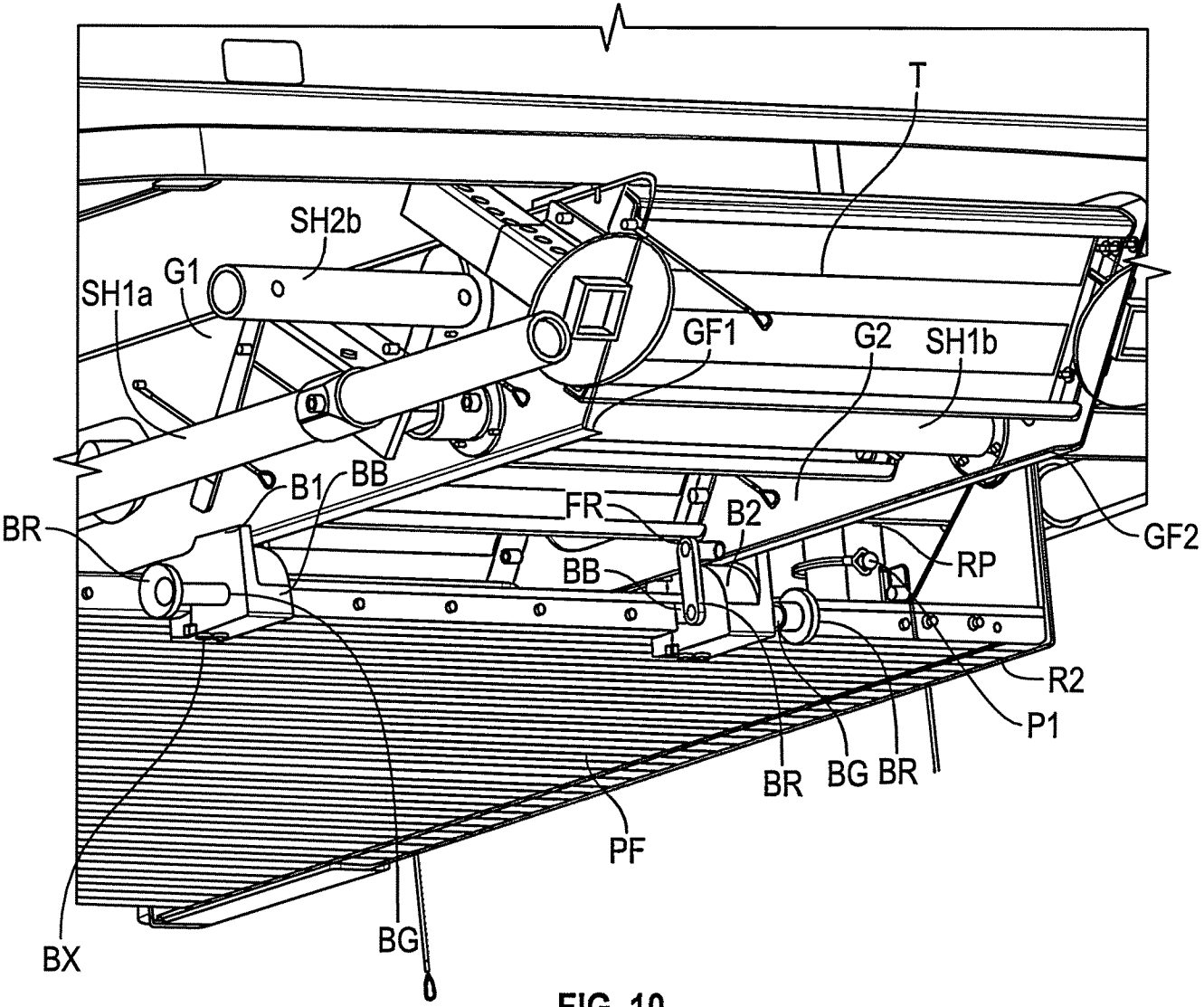
FIGS. 10 & 11 are respectively similar to FIGS. 8 & 9 but show the platform and stair assembly from below.
Figure 11:
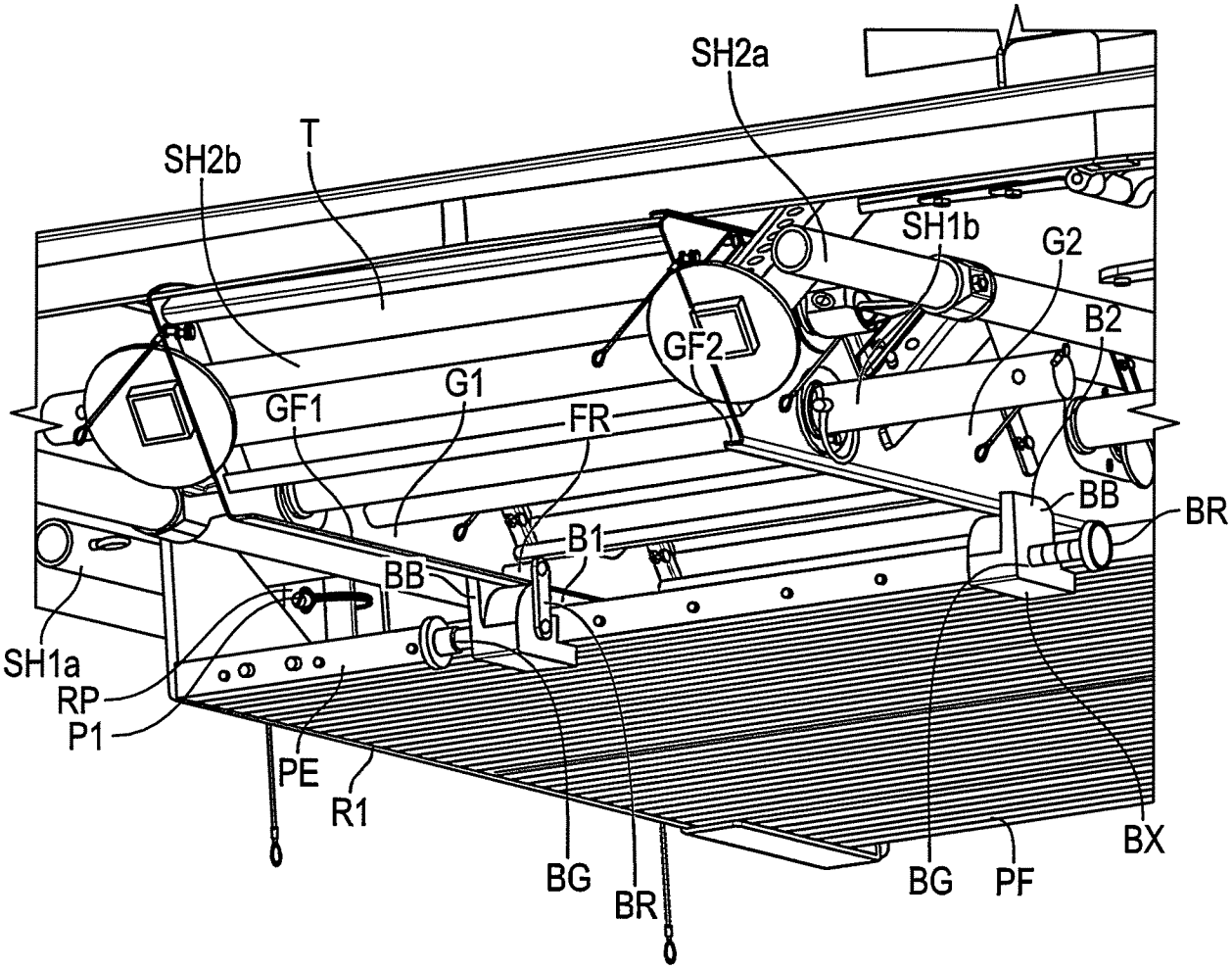
Figure 12:
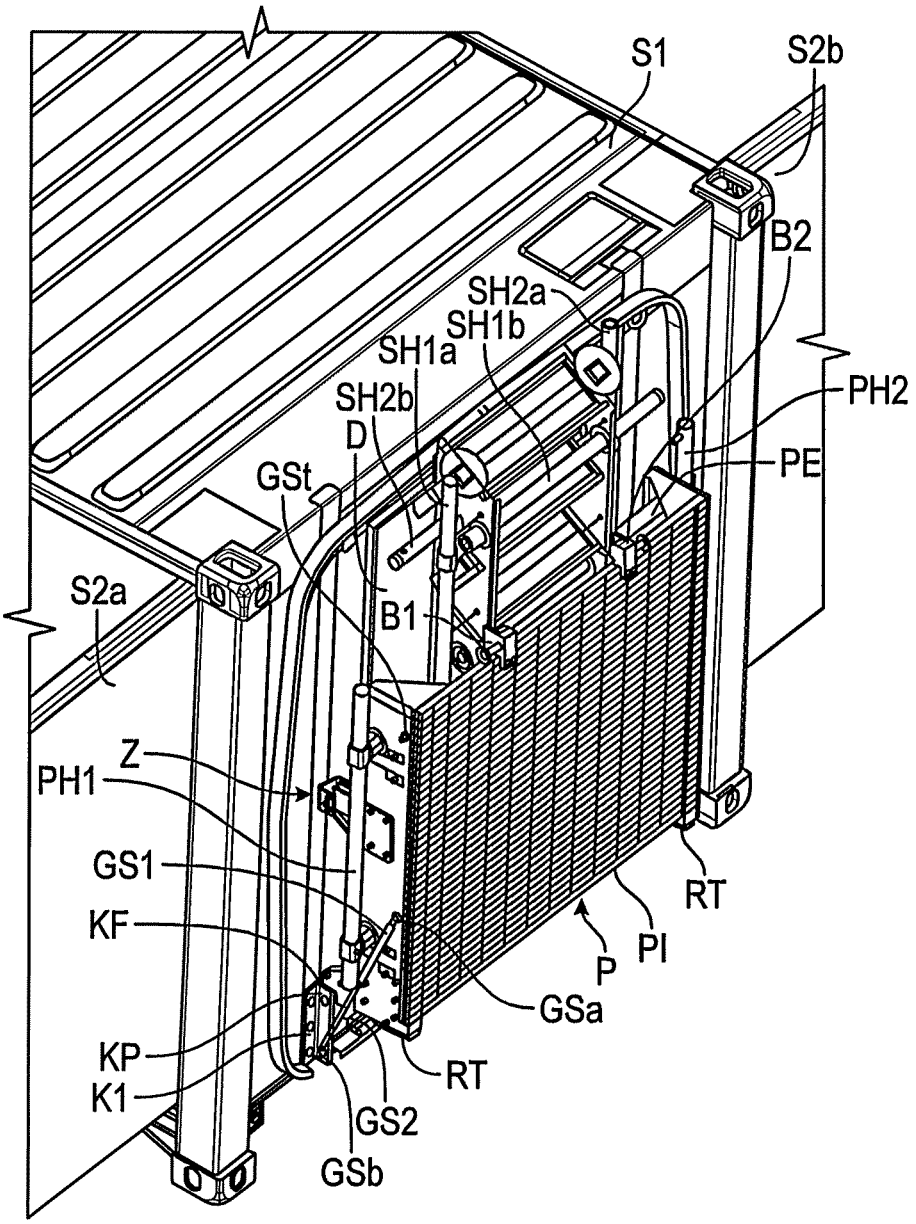
FIGS. 12 & 13 are partial isometric views that are respectively similar to FIGS. 1 & 2 but show both the stair assembly and the platform in the stowed/retracted position.
Figure 13:
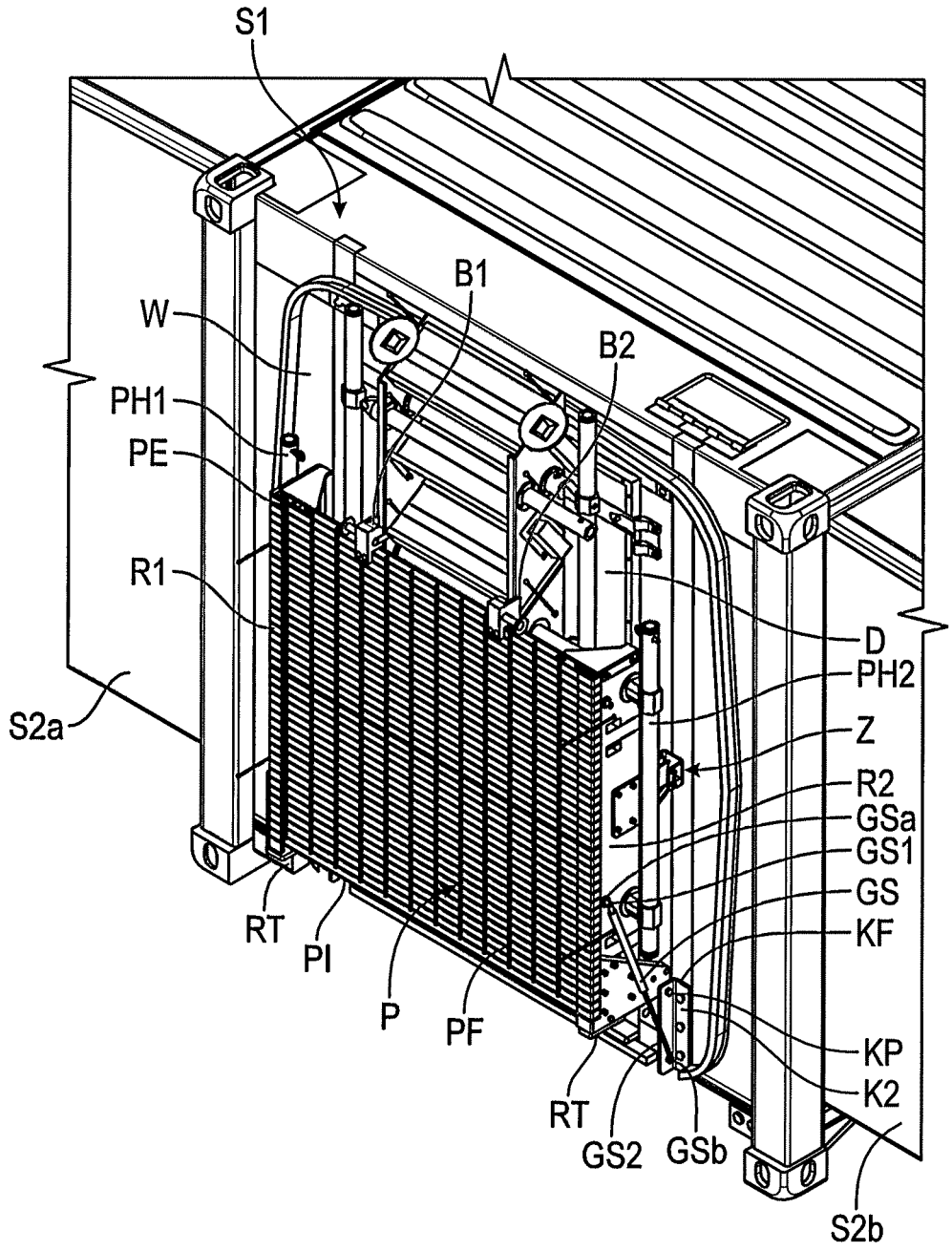
Figure 16:
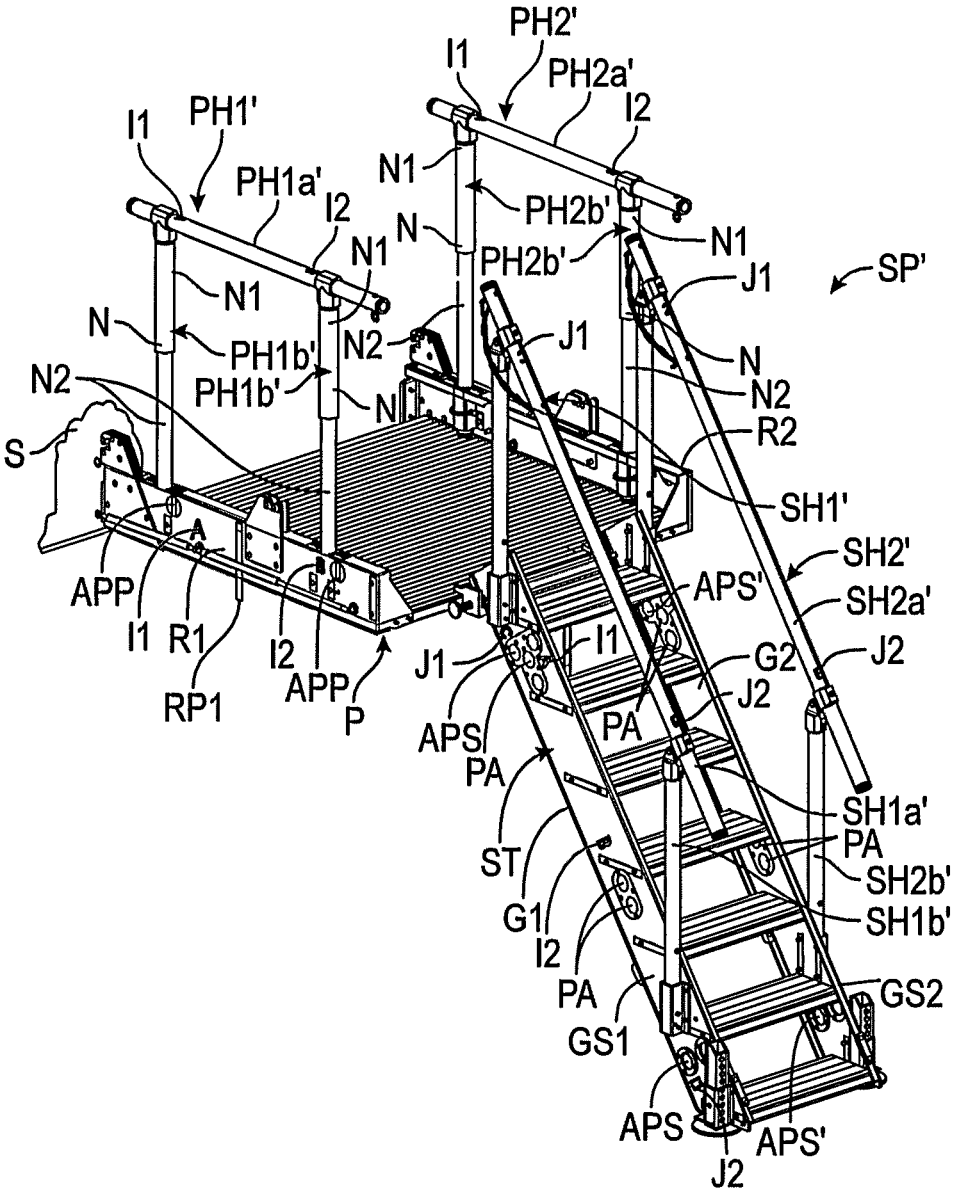
FIG. 16 is an isometric view that shows a stairs and platform system for a shelter in accordance with an alternative embodiment, with both the stairs and platform in their respective extended or deployed positions.
Figure 17:
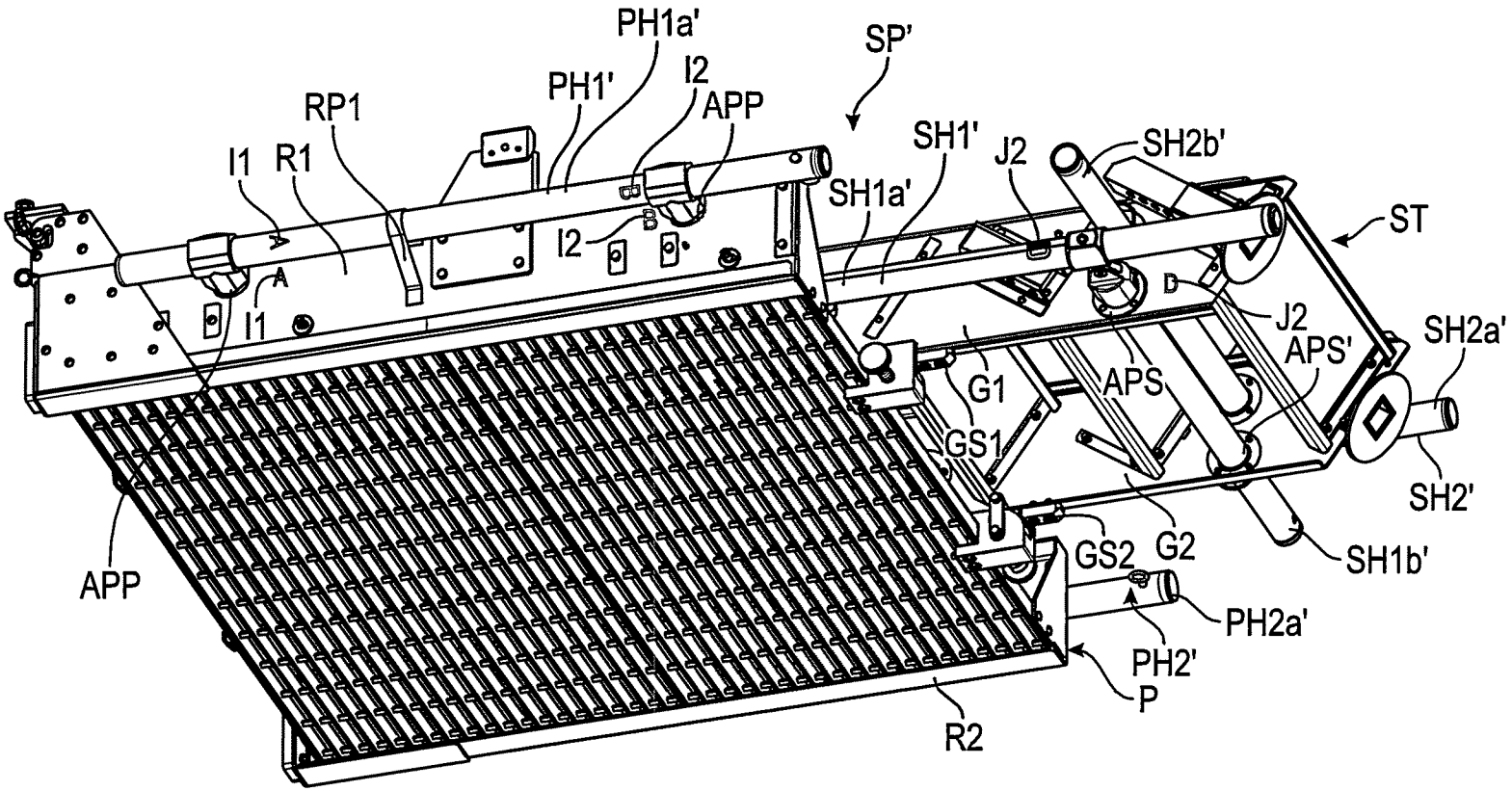
FIG. 17 is an isometric view from below that shows the stairs and platform system of FIG. 16, with the stairs in the stowed/retracted position.
Figure 18:
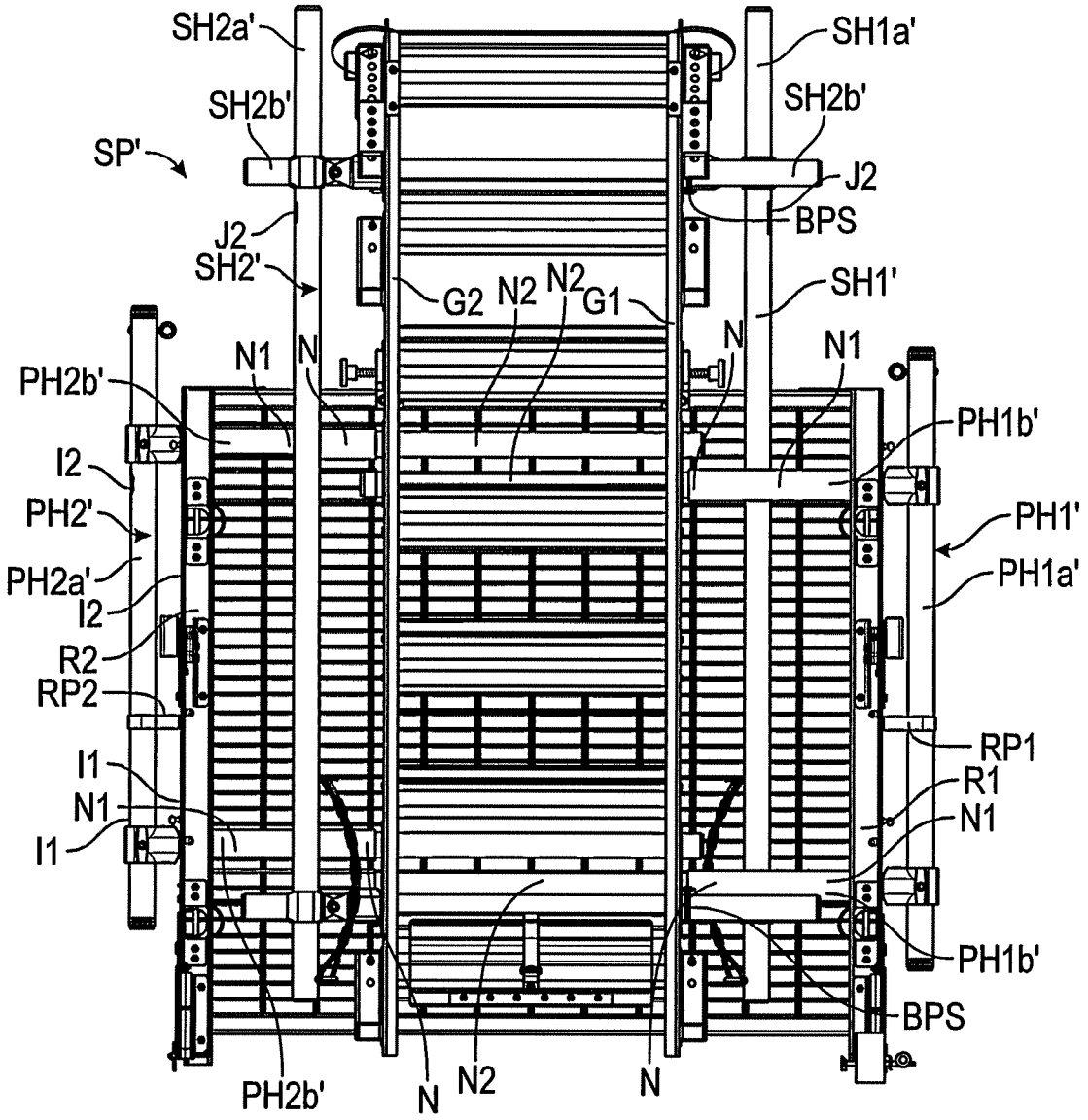
FIG. 18 is a top plan view of the stowed/retracted stairs and platform system of FIG. 17.

The stair assembly ST can be movably connected to the platform P using any of a wide variety of structures and arrangements. In the illustrated embodiment, part of the platform P, such as the floor PF thereof, comprises an outer edge PE that extends between the side rails R1,R2 and that is spaced outwardly away from an opposite inner edge PI of the platform P that is located adjacent the shelter wall W. With particular reference also to FIGS. 10 & 11 which each show a partial isometric bottom view of the stair assembly ST in its stowed position relative to the platform P, first and second connection blocks B1,B2 are connected to or formed as part of the platform P and are located adjacent the platform leading edge PE. The first and second stair assembly stringers G1,G2 are respectively engaged in a sliding or other movable arrangement with the first and second connection blocks B1,B2 such that the stringers G1,G2 can slide relative to the connection blocks B1,B2 between the first (deployed) position of the stair assembly ST and the second (stowed) position of the stair assembly ST. The connection blocks also allow the angle of the stringers G1,G2 relative to the platform P to be adjusted as needed. In one non-limiting example, the connection blocks B1,B2 comprise a one-piece molded polymeric body BB defined from a resinous material such as ultra high molecular weight polyethylene (UHMW) or other durable material. The body BB is bolted or otherwise fixedly secured to the platform P adjacent the leading edge PE. In one example, the body BB is secured to the platform P using bolts or other fasteners BX. The stringers G1,G2 include respective transverse flanges GF1,GF2 (FIGS. 10 & 11) that are slidably engaged with the body BB. The connection blocks B1,B2 comprises respective spring-loaded retainers BR that are movably connected to the respective body BB and that move between a first (operative) position as shown and a second (inoperative) position. The retainers BR are spring-biased to the illustrated first, operative position relative to the respective connection block body BB by a coil spring BG coaxially positioned about a shaft portion of the retainer BR. In this first or operative position, a projecting finger FR of the retainer BR extends over or above and captures the respective stringer flange GF1,GF2 adjacent the block body BB in a manner that prevents the stringers G1,G2 from being separated from the respective connection blocks B1,B2 but that allows the stringer flanges GF1,GF2 to slide relative to the block body BB for sliding movement of the stair assembly ST between its first (deployed) and second (stowed) positions. The spring-loaded retainers BR include a handle by which they are selectively manually moved against the biasing force of the spring BG to a second, inoperative position when the finger FR is moved away from the stringer flange GF1,GF2 to allow the stringer G1,G2 to be separated from its respective connection block B1,B2. As shown in the embodiment of FIGS. 16-18, the stringers G1,G2 can include respective stringer stops GS1,GS2 connected to the stringer flanges GF1,GF2 or elsewhere that contact and abut the respective connection blocks B1,B2 to prevent further movement of the stringers away from the deployed position when the stair assembly ST is fully moved to its stowed position.

Referring again to FIGS. 1-5, the stair assembly ST preferably comprises first (left) and second (right) stair handrail assemblies SH1, SH2 located respectively adjacent the first (left) and second (right) lateral sides of the stair assembly ST. In an alternative embodiment, only one of the stair handrail assemblies SH1, SH2 is provided. As shown in FIGS. 1-5, the stair handrail assemblies SH1,SH2 are configured in their respective first or operative positions in which the first and second platform handrail assemblies SH1,SH2 are respectively connected to the first and second stair stringers G1,G2 and project respectively upward or outward therefrom with the first stair handrail SH1*a* spaced above and arranged parallel to or otherwise extending above the first stringer G1 and with the second stair handrail SH2*a* arranged parallel to or otherwise extending above the second stringer G2 such that the first and second stair handrail assemblies SH1,SH2 provide safety barriers on the opposite first and second lateral sides of the stair assembly ST. More particularly, the first stair handrail assembly SH1 comprises a stair handrail SH1*a* that extends between and is supported by at least one and preferably at least two spaced-apart stair handrail balusters SH1*b* that are releasably connected to the first stringer G1. Similarly, the second stair handrail assembly SH2 comprises a handrail SH2*a* that extends between and is supported by at least one and preferably at least two spaced-apart stair handrail balusters SH2*b* that are releasably connected to the second stringer G2. The first and second stair stringers G1,G2 include pockets KS or other receivers that are adapted to slidably receive the respective stair handrail balusters SH1*b*, SH2*b* and the balusters can be releasably retained in the pockets RS by a wide variety of suitable fasteners such as by a removable pin N3 that is inserted through aligned apertures in the pocket KS and the respective baluster SH1*b*, SH2*b*.

With particular reference to the side views of FIGS. 4 & 5, the first stair stringer G1 includes at least one and preferably at least two stair handrail storage apertures APS corresponding in number to the number of balusters SH1*b* of the first stair handrail assembly SH1 (i.e., the first stringer G1 includes first and second stair handrail storage apertures APS), and the second stair stringer G2 similarly includes at least one and preferably at least two stair handrail storage apertures APS corresponding in number to the number of balusters SH2*b* of the second stair handrail assembly PH2 (i.e., the second stringer G2 includes third and fourth stair handrail storage apertures APS). The two or more storage apertures APS of the first stringer G1 are conformed, dimensioned, and arranged relative to each other to slidably receive the respective balusters SH1*b* of the first stair handrail assembly SH1 when the first stair handrail assembly SH1 is moved from its first or operative position shown in FIGS. 1-5 where the balusters SH1*b* are received and retained in the pockets KS to an inoperative or second position as shown in FIGS. 8-15 where the balusters SH1*b* are removed from the pockets KS and slidably inserted into respective storage apertures APS of the first stringer G1. Likewise, the two or more storage apertures APS of the second stringer G2 are conformed, dimensioned, and arranged relative to each other to slidably receive the respective balusters SH2*b* of the second stair handrail assembly SH2 when the second stair handrail assembly SH2 is moved from the first/operative position shown in FIGS. 1-5 where the balusters SH2*b* are received and retained in the pockets KS to an inoperative or second position as shown in FIGS. 8-15 where the balusters SH2*b* are removed from the pockets KS and slidably inserted into respective storage apertures APS of the second stringer G2. In the illustrated example, the stair handrail balusters SH1*b*, SH2*b* are longer than the lateral distance between the stair stringers G1,G2 such that when the stair handrail balusters SH1*b*, SH2*b* are respectively inserted fully into the storage apertures APS of the first and second stringers G1,G2, the stair balusters SH1*b*, SH2*b* extend through corresponding aligned apertures APS' located in the opposite stringer G2,G1 and respectively aligned with the storage apertures APS. When the first and second stair handrail assemblies SH1,SH2 are located and configured in their respective stowed, inoperative (second or storage) positions, the first and second handrails SH1*a*, SH2*a* thereof lie respectively adjacent the first and second stringers G1,G2. The stair handrail balusters SH1*b*, SH2*b* can be secured in their respective stowed, inoperative (second or storage) positions using a bail pin or other fastener BPS (see FIGS. 14 & 18) that is inserted through aligned apertures located in the stair handrail baluster SH1*b*, SH2*b* to provide an enlarged structure that prevents withdrawal of the stair handrail baluster SH1*b*, SH2*b* from the respective storage apertures APS,APS'. The storage apertures APS need not have a closed perimeter and can be provided as an open notch.

Figure 8:
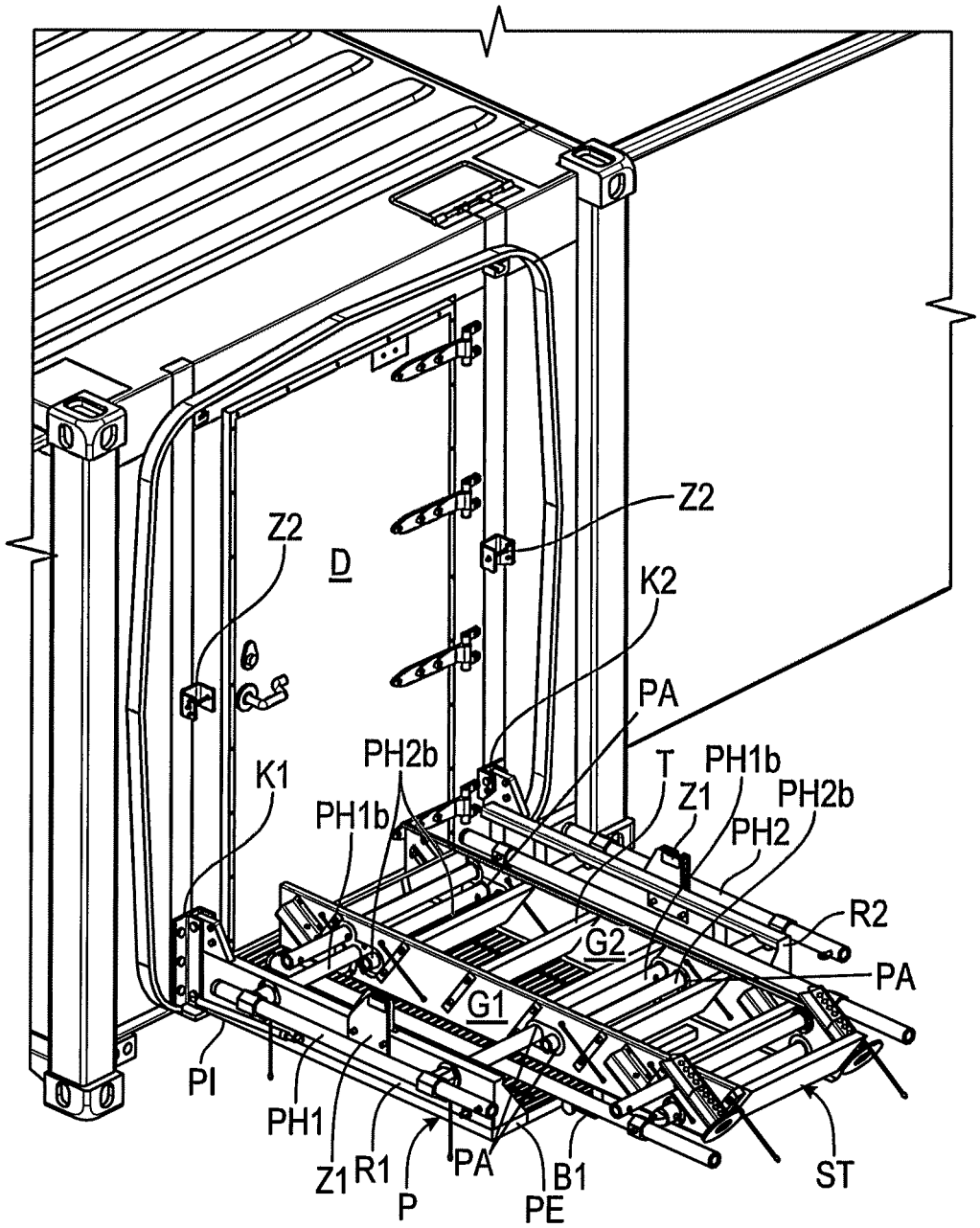
FIGS. 8 & 9 are respectively similar to FIGS. 1 & 2 but show the stair assembly in its second, stowed/retracted position.
Figure 9:
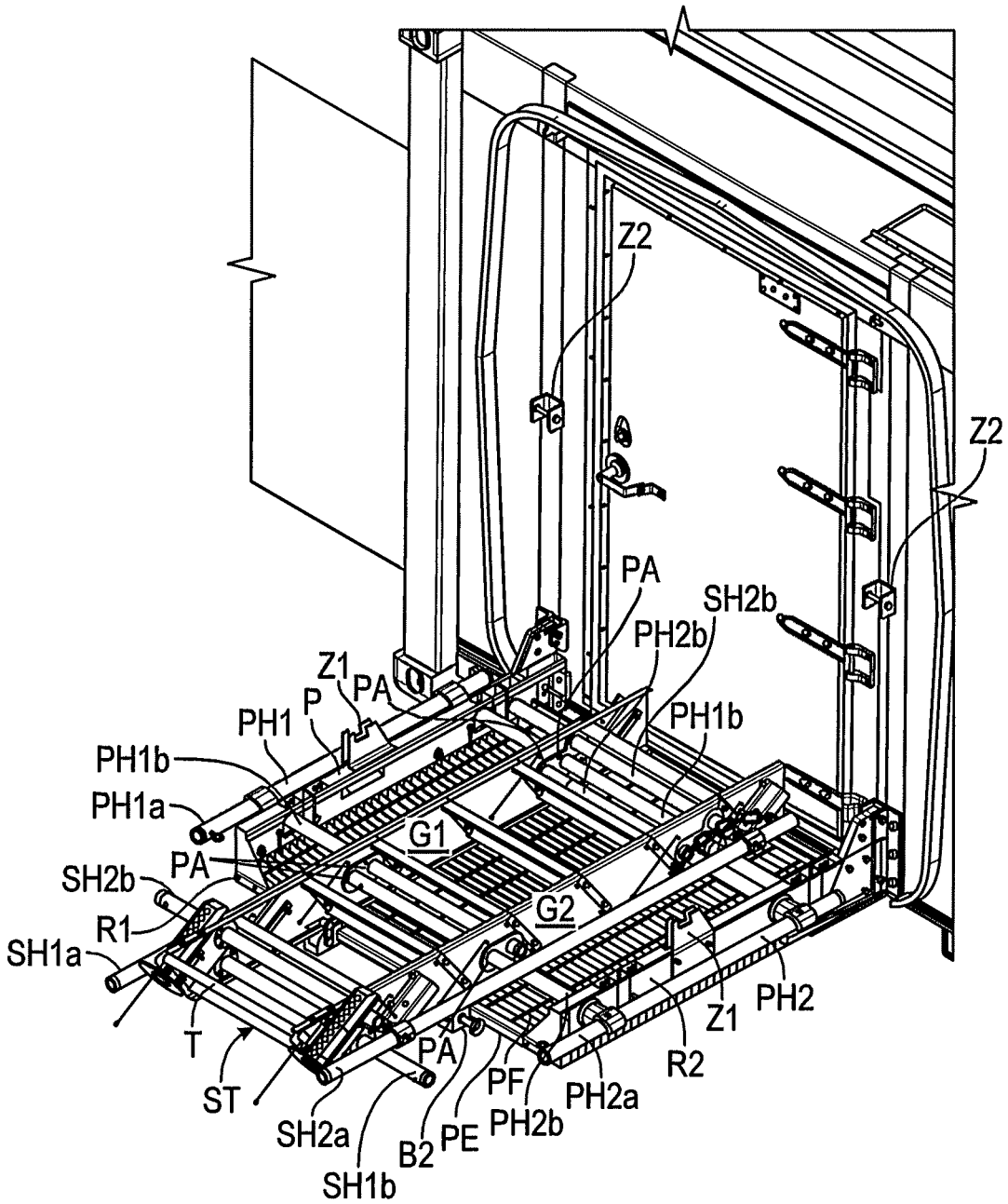

As can be seen in FIGS. 8 & 9, the stairs ST can be moved from the operative position of FIGS. 1-5 to an inoperative retracted or stowed position where the stairs ST are located on or adjacent the platform P between the platform side rails R1,R2. Before being moved to this stowed position, the stair handrails SH1,SH2 are removed from their respective operative positions and installed or positioned in their respective inoperative stowed positions with the stair handrail balusters SH1*b*,SH2*b* thereof installed in the aligned storage apertures APS,APS' such that the handrails SH1*a*,SH2*a* lie adjacent the stringers G1,G2, respectively, and such that the stair handrail balusters SH1*b*,SH2*b* are arranged perpendicularly or otherwise transversely relative to the stringers G1,G2 and extend between and through the stringers G1,G2 (see also the top view of FIG. 18). This stowed position of the stair handrails SH1,SH2 allows the stair handrails to be located between the platform side rails R1,R2 when the stair assembly ST are moved to the stowed position. After the stairs ST are located in the stowed position between the platform side rails R1,R2, the platform handrails PH1,PH2 are moved from their respective operative positions to their respective stowed or inoperative positions with the balusters PH1*b*, PH2*b* thereof installed in the storage apertures APP of the first and second side rails R1,R2. It should be noted that the stair stringers G1,G2 include pass-through apertures PA that are aligned in pairs between the stringers G1,G2, and each aligned pair of pass-through apertures PA receives and accommodates the passage there through of one of the platform handrail balusters PH1*b*,PH2*b* when the platform handrails PH1,PH2 are moved to their respective stowed positions when the stairs ST are located in the stowed position. In other words, a first aligned pair of pass-through apertures PA receives the first platform handrail baluster PH1*b* and a second aligned pair of pass-through apertures PA receives the second platform handrail baluster PH2*b*. The pass-through apertures PA need not have a closed perimeter and can be provided as an open notch. In the inoperative position of the platform handrails PH1,PH2, the platform handrail balusters PH1*b*,PH2*b* can lie parallel to the platform floor PF and be arranged perpendicularly or otherwise transversely relative to the first and second side rails R1,R2 and the first and second stringers G1,G2.

The stair assembly connection blocks B1,B2 position the stringers G1,G2 on the platform P so that the pass-through apertures PA are aligned with the corresponding storage apertures APP of the platform side rails R1,R2. Engagement of the platform balusters PH1*b*,PH2*b* with both the storage apertures APP of the platform P and also with the pass-through apertures PA of the stair assembly ST causes the platform handrail balusters PH1*b*,PH2*b* to capture and retain the stair assembly ST in its stowed position on the platform P. The engagement of the platform handrail balusters PH1*b*, PH2*b* with the stair stringers G1,G2 to capture and retain the stair assembly ST on or adjacent the platform P in its inoperative stowed position can be seen in FIGS. 8, 9, and 14 (note that in FIG. 14, the platform floor PF is not shown to review the engagement of the platform handrail balusters PH1*b*.PH2*b* with the stair assembly stringers G1,G2). The platform handrail balusters PH1*b*,PH2*b* can be secured in their respective stowed, inoperative positions using a bail pin or other fastener BPP (FIG. 14) that is inserted through aligned apertures located in the platform handrail baluster PH1*b*,PH2*b* to provide an enlarged structure that prevents withdrawal of the platform handrail baluster PH1*b*,PH2*b* from the respective pass-through apertures PA of the stair stringers G1,G2.

When the stair assembly ST is located in its stowed position on or adjacent the platform as shown in FIGS. 8-15, the platform P can be selectively manually pivoted from its extended or deployed (down) position of FIGS. 1-5 to its retracted or stowed (up) position of FIGS. 12-15 where the platform P lies adjacent the wall W and door D. In its stowed position, the platform P can be arranged vertically and parallel with the door D.

The stair and platform system SP can also comprise a latch system for selectively retaining the platform P and stairs ST in the stowed position of FIGS. 12-15. In one example, the system comprises at least one and, as shown herein, first and second latch systems Z (FIG. 15) each comprising first and second mating latch components Z1 and Z2 connected respectively to the platform P and to part of the shelter body B such as the shelter wall W. As shown herein, the first latch components Z1 each comprise a selectively releasably latch assembly connected respectively to the platform P. In the illustrated example, the first and second latch components Z1 are respectively connected to the first and second platform side rails R1,R2. The second latch components Z2 each comprise a mating striker pin or other structure for engaging and mating with the first latch component Z1 and are mounted to the wall W or other part of the shelter body B. The striker pins or other second latch components Z2 are positioned and configured to be respectively engaged and retained by first latch components Z1 when the platform P is pivoted to its stowed position. When the first and second latch components are engaged, the platform P is prevented from being pivoted away from its stowed position toward its deployed position. The latch assemblies Z1 can be selectively manually released to disengage from the striker pin or other second latch component Z2 as needed to allow the platform P to pivot toward its deployed position. As shown herein, each latch assembly Z1 comprises a cord or other release actuator Z3 (FIG. 15) that is pulled or otherwise actuated by a user to open the latch assembly Z1 so that it releases the striker pin or other second latch component Z2.

FIGS. 16-18 show a stairs and platform system for a shelter in accordance with an alternative embodiment SP'. Except as otherwise shown and/or described herein, the stairs and platform system SP' is identical to the stairs and platform system SP and like reference numbers/letters are used for like components, in some cases with a prime (') designation to indicate an optional variation in structure. FIG. 16 shows the stairs ST and platform P in their respective extended or deployed positions while FIGS. 17 & 18 show the stairs ST and platform P in their respective retracted or stowed positions. Unlike the stairs and platform system SP, the stairs and platform system SP' comprises first and second platform handrail retention straps RP1,RP2 respectively connected to the first and second platform side rails R1,R2. The straps can be providing by webbing, cord, and/or another strap material. As shown in FIGS. 17 & 18, when the first and second platform handrail assemblies PH1',PH2' are located in their stowed positions, the first and second straps RP1,RP2 are respectively engaged with the first and second platform handrail assemblies PH1',PH2' (in particular with the first and second platform handrails PH1*a*',PH2*a*') to secure and capture the first and second handrail assemblies PH1',PH2' to the respective platform side rail R1,R2 in the stowed position. The retention straps RP1,RP2 can include any suitable clasp or fastening element such as a mechanical clasp and/or a hook-and-loop fastening element or the like to secure the retention strap RP1,RP2 to itself and/or to the side rail R1,R2 to capture the respective platform handrail PH1*a*',PH2*a*'.

FIGS. 16 & 17 also show that the stairs and platform system SP' can comprise an optional indicia system for aiding users in properly inserting the platform handrail balusters PH1*b*',PH2*b*' in the proper or intended storage apertures APP,APS. In particular, it can be seen that the first platform side rail R1 includes first and second platform handrail storage aperture indicia I1,I2 respectively adjacent or otherwise associated with the first and second platform storage apertures APP (shown respectively as the letters "A" and "B" but other indicia can be used) and that the platform handrail assemblies PH1',PH2' each comprise matching first and second platform handrail assembly indicia I1,I2 aligned or otherwise associated respectively with the first and second balusters PH1*b*',PH2*b*' to indicate that the respective platform handrail balusters PH1*b*,PH2*b* are to be inserted in the storage apertures APP including correspondingly marked indicia I1,I2 (the indicia I1,I2 on the second platform side rail R2 can be identical to the indicia I1,I2 on the first side rail R1). The indicia can be provided by paint, ink, engraving or embossing, stickers, colors, a stencil, or the like. The first and second indicia I1,I2 can also be included in the first and second stair stringers adjacent or otherwise associated with the corresponding pass-through apertures PA Similarly, it can be seen that the first stair stringer G1 includes first and second stair handrail storage aperture indicia J1,J2 respectively adjacent or otherwise associated with first and second storage apertures APS of the stairs ST (shown respectively as the letters "C" and "D" but other indicia can be used) and that the stair handrail assemblies SH1',SH2' each comprise matching first and second stair handrail assembly indicia J1,J2 aligned or otherwise associated respectively with the first and second stair handrail balusters SH1*b*',SH2*b*' to indicate that the respective balusters SH1*b*',SH2*b*' are to be inserted in the storage apertures APS including correspondingly marked indicia J1,J2 (the indicia J1,J2 on the second stringer G2 is not visible in FIGS. 16 & 17 but can be identical to the indicia J1,J2 on the first stringer G1). Also, the first and second stringers G1,G2 can also include the platform side rail indicia I1,I2 adjacent or otherwise associated with the pass-through aperture PA that is to receive the correspondingly marked platform handrail baluster PH1*b*,PH2*b* for additional guidance of the location for the platform handrail balusters PH1*b*',PH2*b*'.

With reference to FIGS. 16 & 18, its can be seen that at least one (and preferably both) of the platform handrail balusters PH1*b*',PH2*b*' of each of the first and second platform handrail assemblies PH1',PH2' of the stairs and platform system SP' can further comprise an enlarged shoulder N provided on upper portion N1 thereof between the platform handrail PH1*a*',PH2*a*' and the distal or outer/lower portion N2 that is spaced farthest away from the platform handrail PH1*a*',PH2*a*'. The enlarged shoulder N can be provided by an enlarged annular sleeve or collar or by any other enlarged or outwardly extending protuberance or structure connected to the upper portion N1 of the platform handrail baluster PH1*b*',PH2*b*'. As such, each platform handrail baluster PH1*b*',PH2*b*' includes a first or upper portion N1 including an enlarged structure N that is radially or otherwise enlarged and that projects outwardly or protrudes relative to a second or lower portion N2. The enlarged shoulder structure N is dimensioned such that it defines the upper portion N1 so that it can be received into and through the relevant storage aperture APP of the platform side rail R1,R2 but so that the upper portion N1 is too large in diameter or otherwise enlarged and unable to be received into and/or through the aligned pass-through apertures PA of the stair stringers G1,G2. On the other hand, the lower portion N2 is sized to be received into and through both the side rail storage apertures APP and also the pass-through apertures PA of the stringers G1,G2. As such, as shown in FIG. 18, when the platform handrail assemblies PH1',PH2' are located and secured in their stowed positions, the upper portion N1 of each first platform handrail baluster PH1*b*' is located in a fixed position with its enlarged shoulder N located adjacent the first stair stringer G1, while the upper portion N1 of each second platform handrail baluster PH2*b*' is located in a fixed position with its enlarged shoulder N located adjacent the second stair stringer G2. Because the enlarged shoulder N or other enlarged upper portions N1 are too large to be received into the pass-through apertures PA of the stringers G1,G2, the stair assembly ST is captured between the enlarged upper portion N1/shoulder N of the first and second handrail balusters PH1*b*',PH2*b*' and prevented from moving laterally more than a minimal distance. The enlarged shoulder N of the or each platform handrail baluster PH1*b*' blocks movement of the stair assembly ST toward the first platform rail R1 while the enlarged shoulder N of the or each platform handrail baluster PH2*b*' blocks movement of the stair assembly ST toward the second platform rail R2.

In the preceding specification, various embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

The invention claimed is:

1. A shelter comprising:

a body including a wall;

a platform connected adjacent to said wall, said platform including: (i) first and second spaced-apart side rails and a platform floor located between the first and second side rails; (ii) first and second platform handrail assemblies respectively located on opposite first and second lateral sides of the platform, each of said first and second platform handrail assemblies including first and second handrail balusters and a platform handrail that extends between the first and second handrail balusters;

a stair assembly connected to the platform to provide access to the platform, said stair assembly movable relative to said platform from a first operative position in which said stair assembly projects outwardly away from the platform to a second stowed position in which said stair assembly is retracted relative to the platform and at least part of the stair assembly is supported adjacent the platform;

said first and second platform handrail assemblies each selectively configurable to be in: (i) an operative position in which said first and second handrail balusters of the first and second platform handrail assemblies project respectively upwardly from said opposite first and second lateral sides of the platform; and (ii) a storage position in which said first and second handrail balusters of the first and second platform handrail assemblies engage both the platform and the stair assembly to capture and retain the stair assembly in its stowed position.

2. The shelter as set forth in claim 1, wherein said stair assembly further comprises first and second stair handrail assemblies, wherein said first and second stair handrail assemblies are each selectively configured in one of: (i) a first position in which said first and second stair handrail assemblies project respectively upwardly from opposite first and second lateral sides of the stair assembly; (ii) a second position.

3. The shelter as set forth in claim 2, wherein:

said stair assembly comprises first and second stringers that support a plurality of steps.

4. A shelter comprising:

a body including a wall;

a platform connected adjacent to said wall, said platform including: (i) first and second spaced-apart side rails and a platform floor located between the first and second side rails; (ii) first and second platform handrail assemblies respectively located on opposite first and second lateral sides of the platform;

a stair assembly connected to the platform to provide access to the platform, said stair assembly movable relative to said platform from a first operative position in which said stair assembly projects outwardly away from the platform to a second stowed position in which said stair assembly is retracted relative to the platform and at least part of the stair assembly is supported adjacent the platform, wherein said stair assembly comprises first and second stair handrail assemblies, wherein said first and second stair handrail assemblies are each selectively configured in one of: (i) a first position in which said first and second stair handrail assemblies project respectively upwardly from opposite first and second lateral sides of the stair assembly; (ii) a second position;

said first and second platform handrail assemblies each selectively configurable to be in: (i) an operative position in which said first and second platform handrail assemblies project respectively upwardly from said opposite first and second lateral sides of the platform; and (ii) a storage position in which the first and second platform handrail assemblies engage both the platform and the stair assembly to capture and retain the stair assembly in its stowed position;

wherein:

said stair assembly comprises first and second stringers that support a plurality of steps;

said first and second platform handrail assemblies each comprise: (i) first and second platform handrail balusters; and (ii) a platform handrail that extends between the first and second platform handrail balusters;

when said first platform handrail assembly is in its storage position said first and second platform handrail balusters of said first platform handrail assembly: (i) extend through respective platform handrail storage apertures located in said first side rail of said platform; and (ii) each extend through a respective aligned pair of pass-through apertures located in said first and second stair stringers;

when said second platform handrail assembly is in its storage position said first and second platform handrail balusters of said second platform handrail assembly: (i) extend through respective platform handrail storage apertures located in said second side rail of said platform; and (ii) each extend through a respective aligned pair of pass-through apertures located in said first and second stair stringers.

5. The shelter as set forth in claim 4, wherein said first and second stair handrail assemblies each comprise: (i) first and second stair handrail balusters; and (ii) a stair handrail that extends between said first and second stair handrail balusters.

6. The shelter as set forth in claim 5, wherein:

when said first stair handrail assembly is in its second position, said first and second stair handrail balusters of said first stair handrail assembly extend through respective aligned stair handrail storage apertures located in said first and second stringers of said stair assembly;

when said second stair handrail assembly is in its second position, said first and second stair handrail balusters of said second stair handrail assembly extend through respective aligned stair handrail storage apertures located in said first and second stringers of said stair assembly.

7. The shelter as set forth in claim 6, wherein the first and second stair handrails of the first and second stair handrail assemblies are located respectively adjacent the first and second stringers and are located between the first and second platform side rails when the stair assembly is located in its stowed position and when said first and second stair handrail assemblies are located in their respective second positions.

8. The shelter as set forth in claim 7, wherein, when the first and second platform handrail assemblies are configured to be in their storage positions:

the first and second platform handrails of the first and second platform handrail assemblies are located respectively adjacent the first and second platform side rails; and the first and second platform handrail assemblies are secured to the platform.

9. The shelter as set forth in claim 8, wherein, the platform further comprises first and second straps that secure the first and second platform handrail assemblies respectively to the platform when the first and second platform handrail assemblies are configured to be in their storage positions.

10. The shelter as set forth in claim 6, wherein:

each platform handrail storage aperture of the platform is labeled with platform handrail storage aperture indicia that corresponds to platform handrail assembly indicia associated respectively with the first and second balusters of the first and second platform handrail assemblies; and, each stair handrail storage aperture of the stair assembly is labeled with stair handrail storage aperture indicia that corresponds to stair handrail assembly indicia associated respectively with the first and second balusters of the first and second stair handrail assemblies.

11. The shelter as set forth in claim 1, wherein said stair assembly is slidably connected to the platform and slides relative to the platform between the first operative position of the stair assembly and the second stowed position of the stair assembly.

12. The shelter as set forth in claim 11, further comprising first and second polymeric connection blocks secured to the platform and slidably engaged respectively with first and second stringers of said stair assembly.

13. The shelter as set forth in claim 12, further comprising first and second stringer stops connected respectively to the first and second stringers that respectively engage the first and second connection blocks when the stair assembly is located in its second stowed position.

14. The shelter as set forth in claim 1, wherein said platform is pivotally connected to the shelter body and pivots relative to said shelter body between an extended position where the platform is extended outwardly relative to said wall and a retracted position where the platform is located adjacent said wall.

15. The shelter as set forth in claim 14, further comprising a latch system comprising first and second latch components connected respectively to the platform and the shelter body and that are selectively engaged to retain the platform in the retracted configuration.

16. The shelter as set forth in claim 4, wherein:

said first and second platform handrail balusters of both said first and second platform handrail assemblies each comprise an upper portion including an enlarged shoulder and a lower portion;

when said first platform handrail assembly is located in its storage position, said enlarged shoulder of said upper portion of both said first and second balusters of said first platform handrail assembly is located adjacent said first stringer of said stair assembly and blocks movement of the stair assembly toward the first side rail of the platform;

when said second platform handrail assembly is located in its storage position, said enlarged shoulder of said upper portion of both said first and second balusters of said second platform handrail assembly is located adjacent said second stringer of said stair assembly and blocks movement of the stair assembly toward the second side rail of the platform.

17. A stairs and platform system for a shelter, said system comprising:

a platform adapted to be connected to an associated shelter, said platform including: (i) first and second spaced-apart side rails and a platform floor located between the first and second side rails; (ii) first and second platform handrail assemblies;

a stair assembly connected to the platform, said stair assembly selectively positionable relative to said platform in: (i) a first operative position in which said stair assembly projects outwardly away from the platform to provide access to the platform; and (ii) a second stowed position in which said stair assembly is retracted relative to the platform and at least part of the stair assembly is supported adjacent the platform;

said first and second platform handrail assemblies each selectively positionable in: an operative position in which said first and platform handrail assemblies project respectively upward on opposite lateral sides of the platform; and (ii) a storage position in which said first and second platform handrail assemblies are engaged with both the platform and the stair assembly to capture and retain the stair assembly in its stowed position.

18. The stairs and platform system as set forth in claim 17, wherein said stair assembly comprises: (i) first and second stringers; (ii) a plurality of steps that extend between the first and second stringers; and (iii) first and second stair handrail assemblies, wherein said first and second stair handrail assemblies each comprise first and second balusters connected to a stair handrail;

said first and second stair handrail assemblies each selectively positionable in: (i) an first configuration in which said first and second stair handrail assemblies project respectively upwardly on opposite lateral sides of the stair assembly; (ii) a second configuration in which both said first and second balusters of both said first and second stair handrail assemblies extend through respective pairs of aligned apertures defined in said first and second stringers such that said first and second balusters of both said first and second stair handrail assemblies extend between and through both the first and second stringers.

19. The stairs and platform system as set forth in claim 18, wherein:

said first and second platform handrail assemblies each comprise: (i) first and second platform handrail balusters; and (ii) a platform handrail that extends between the first and second platform handrail balusters;

when said first platform handrail assembly is in its storage position, said first and second platform handrail balusters of said first platform handrail assembly each: (i) extend through a respective platform handrail storage aperture located in a first side rail of said platform; and (ii) extend through a respective aligned pair of pass-through apertures located in said first and second stair stringers;

when said second platform handrail assembly is in its storage position said first and second platform handrail balusters of said second platform handrail assembly each: (i) extend through a respective platform handrail storage aperture located in a second side rail of said platform; and (ii) each extend through a respective aligned pair of pass-through apertures located in said first and second stair stringers.

20. The stairs and platform system as set forth in claim 19, wherein said stair assembly is captured between an enlarged shoulder located on an upper portion of at least one of the first and second balusters of the first platform handrail assembly that lies adjacent the first stair assembly stringer and an enlarged shoulder located on an upper portion of at least one of the first and second balusters of the second platform handrail assembly that lies adjacent the second stair assembly stringer when said first and second platform handrail assemblies are each located in the stowed position.

* * * * *